US011598129B2

(12) United States Patent
Margheritti et al.

(10) Patent No.: US 11,598,129 B2
(45) Date of Patent: Mar. 7, 2023

(54) SMART LATCH ASSEMBLY WITH DOUBLE PAWL LATCH MECHANISM HAVING FLEXIBLE CONNECTION TO RELEASE MECHANISM

(71) Applicant: MAGNA CLOSURES INC., Newmarket (CA)

(72) Inventors: Enrico Margheritti, Lucca (IT); Francesco Patane, Newmarket (CA); Franco Giovanni Ottino, San Giuliano Terme (IT)

(73) Assignee: MAGNA CLOSURES INC., Newmarket (CA)

( * ) Notice: Subject to any disclaimer, the term of this patent is extended or adjusted under 35 U.S.C. 154(b) by 608 days.

(21) Appl. No.: 16/717,964

(22) Filed: Dec. 17, 2019

(65) Prior Publication Data

US 2020/0190861 A1 Jun. 18, 2020

Related U.S. Application Data

(60) Provisional application No. 62/780,980, filed on Dec. 18, 2018.

(51) Int. Cl.

| | |
|---|---|
| ***E05B 81/30*** | (2014.01) |
| ***E05B 81/56*** | (2014.01) |
| ***E05B 85/26*** | (2014.01) |

(52) U.S. Cl.

CPC ..... *E05B 81/30* (2013.01); *E05B 81/56* (2013.01); *E05B 85/26* (2013.01)

(58) Field of Classification Search

CPC ..... E05B 81/06; E05B 81/14; E05B 81/16; E05B 81/30; E05B 81/42; E05B 81/56; E05B 85/20; E05B 85/24; E05B 85/243; E05B 85/26; Y10T 292/1047; Y10T 292/1082; Y10S 292/23

See application file for complete search history.

(56) References Cited

U.S. PATENT DOCUMENTS

| | | | |
|---|---|---|---|
| 3,386,761 | A | 6/1968 | Johnstone et al. |
| 5,092,639 | A | 3/1992 | Di Giusto |
| 5,188,406 | A | 2/1993 | Sterzenbach et al. |
| 6,428,058 | B1 | 8/2002 | Graute |
| 7,434,852 | B2 | 10/2008 | Spurr |
| 8,596,694 | B2 | 12/2013 | Taurasi et al. |
| 8,596,696 | B2 | 12/2013 | Cumbo et al. |
| 8,764,075 | B2 | 7/2014 | Taurasi et al. |
| 9,512,651 | B2 | 12/2016 | Taurasi et al. |
| 9,534,425 | B2 | 1/2017 | Hunt et al. |
| 9,611,677 | B2 | 4/2017 | Bendel et al. |

(Continued)

FOREIGN PATENT DOCUMENTS

| | | | |
|---|---|---|---|
| CN | 102844513 | A | 12/2012 |
| CN | 103806772 | A | 5/2014 |

(Continued)

*Primary Examiner* — Christine M Mills
*Assistant Examiner* — Christopher F Callahan
(74) *Attorney, Agent, or Firm* — Dickinson Wright PLLC

(57) ABSTRACT

A closure latch assembly equipped with a double pawl latch mechanism and including a resilient linkage arrangement between a component of the double pawl latch mechanism and a component of a latch release and reset mechanism which is configured to assist in both latch release and latch reset operations.

19 Claims, 36 Drawing Sheets

(56) References Cited

U.S. PATENT DOCUMENTS

| | | | | |
|---|---|---|---|---|
| 10,648,204 | B2 | 5/2020 | Cumbo et al. | |
| 2004/0094971 | A1 | 5/2004 | Warmke et al. | |
| 2006/0006671 | A1 | 1/2006 | Noel et al. | |
| 2010/0320777 | A1* | 12/2010 | Jankowski | E05B 77/42 292/200 |
| 2014/0091581 | A1 | 4/2014 | Taurasi et al. | |
| 2015/0368934 | A1 | 12/2015 | Tomaszewski | |
| 2017/0067272 | A1 | 3/2017 | Margheritti | |
| 2017/0089103 | A1* | 3/2017 | Ottino | E05B 81/16 |
| 2017/0138094 | A1 | 5/2017 | Taurasi et al. | |
| 2017/0350173 | A1 | 12/2017 | Cumbo | |
| 2018/0016821 | A1 | 1/2018 | Cumbo et al. | |
| 2018/0030763 | A1* | 2/2018 | Distefano | E05B 77/54 |
| 2019/0085599 | A1 | 3/2019 | Tomaszewski | |

FOREIGN PATENT DOCUMENTS

| | | | | |
|---|---|---|---|---|
| CN | 106150233 | A | 11/2016 | |
| CN | 107035246 | A | 8/2017 | |
| DE | 102007003948 | A1 | 5/2008 | |
| EP | 1580365 | A1 | 9/2005 | |
| EP | 2161398 | A2 | 3/2010 | |
| EP | 3655602 | B1 | 3/2021 | |
| GB | 2433768 | A | 7/2007 | |
| WO | WO-2009143997 | A1 * | 12/2009 | E05B 81/14 |
| WO | WO-2011094834 | A1 * | 8/2011 | E05B 81/14 |
| WO | WO-2012163503 | A1 * | 12/2012 | E05B 15/04 |

* cited by examiner

SMART LATCH ASSEMBLY WITH DOUBLE PAWL LATCH MECHANISM HAVING FLEXIBLE CONNECTION TO RELEASE MECHANISM

CROSS-REFERENCE TO RELATED APPLICATION

This application claims the benefit of U.S. Provisional Application Ser. No. 62/780,980, filed Dec. 18, 2018, which is incorporated herein by way of reference in its entirety.

FIELD

The present disclosure relates generally to closure latch assemblies of the type used in motor vehicle closure systems. More particularly, the present disclosure relates to a closure latch assembly equipped with a double pawl latch mechanism interconnected by a resilient linkage arrangement to a power-operated latch release and reset mechanism.

BACKGROUND

This section provides a general summary of background information related to vehicle door latches and the components and examples provided in this section are not necessarily prior art to the inventive concepts and features provided by the present disclosure.

A vehicle closure member, such as a door for the passenger compartment of a motor vehicle, is typically hinged to swing between open and closed positions and is equipped with a closure latch assembly. The closure latch assembly functions in a well-known manner to latch the door when closed, to lock the door in the closed position, and to unlock and unlatch the door when required to permit the door to be opened and swung to its open position.

The closure latch assembly can be operated remotely from the exterior of the motor vehicle by at least two distinct operators which typically include a key cylinder that controls a "locking/unlocking" operation of a latch mechanism and an outside door handle that controls operation of a latch release mechanism. Similarly, the closure latch assembly can also be operated remotely from inside the passenger compartment by at least two distinct operators which typically include a sill button/pull knob that controls the locking/unlocking operation of the latch mechanism and an inside door handle controlling operation of the latch release mechanism. Modern closure latch assemblies commonly include one or more power-operated features, such as power lock and/or power release functionality for controlling operation of the latch mechanism and/or the latch release mechanism using electric motors which receive control signals from a keyless entry system.

Virtually all closure latch assemblies employ a ratchet and pawl type of latch mechanism for releasably engaging and holding a vehicle-mounted striker when the door is in its closed position. Due to door sealing loads, it is known that a rather large latch release effort may be required to release the pawl from engagement with the ratchet so as to permit the ratchet to subsequently rotate from a striker capture position to a striker release position. As an alternative to single pawl latch mechanism, some closure latch assemblies are equipped with a double pawl latch mechanism which utilize a "primary" ratchet and pawl set that is operably connected to an "auxiliary" ratchet and pawl set. The connection may be configured such that only a portion of the forces exerted on the primary pawl and ratchet set are applied to the auxiliary pawl and ratchet set, thus requiring only relatively low latch release efforts to release the closure latch assembly.

In closure latch assemblies equipped with a power-operated actuator for selectively releasing the double pawl latch mechanism, it is known that the auxiliary ratchet and pawl set must be "reset" back to their initial positions in anticipation of a subsequent door closing operation. The power-operated actuator commonly provides a dual function of providing a "power release" feature and a "power reset" feature in cooperation with the double pawl latch mechanism. Unfortunately, the power reset operation can be rather noisy and typically increases the complexity of the latch release/reset kinematics.

While closure latch assemblies of the type noted above operate satisfactorily for their intended purpose, a recognized need exists to develop alternative closure latch assemblies that improve upon known configurations in terms of enhanced operation, reduced weight, noise and cost, and optimized packaging. In particular, a need is recognized to advance the art related to the power release and resetting of double pawl latch mechanisms by simplifying the configuration thereof via reducing the number of moveable components and the complexity of such components.

SUMMARY

This section provides a general summary of the inventive concepts and features associated with power-operated double pawl closure latch assemblies embodying the teachings of the present disclosure. However, this section is not intended to represent an exhaustive and comprehensive disclosure of the full scope or all the features, objectives, aspects and advantages associated with the present disclosure.

It is an aspect of the present disclosure to provide a closure latch assembly having a double pawl latch mechanism that is released and reset via a power-operated latch release and reset mechanism.

It is a further aspect of the present disclosure to provide a resilient linkage arrangement between a component of the double pawl latch mechanism and a component of the latch release and reset mechanism which is configured to assist in both the power latch release, preferably when no or insufficient seal load is present, and power latch reset operations.

In accordance with these and other aspects, the present disclosure is directed to a closure latch assembly, comprising: a primary ratchet movable between a striker capture position whereat the ratchet is positioned to retain a striker and a striker release position whereat the primary ratchet is positioned to release the striker, wherein the primary ratchet is biased towards its striker release position; a primary pawl movable between a ratchet holding position whereat the primary pawl is positioned to hold the primary ratchet in its striker capture position and a ratchet releasing position whereat the primary pawl permits the movement of the primary ratchet out of its striker capture position, wherein the primary pawl is biased towards its ratchet holding position; an auxiliary ratchet movable between a primary pawl enabling position whereat the auxiliary ratchet permits the primary pawl to be biased toward its ratchet holding position and a primary pawl disabling position whereat the auxiliary ratchet positions the primary pawl in its ratchet releasing position, wherein the auxiliary ratchet is biased towards its primary pawl disabling position; an auxiliary pawl movable between an auxiliary ratchet holding position whereat the auxiliary pawl is positioned to hold the auxiliary ratchet in its primary pawl enabling position and an auxiliary ratchet releasing position whereat the auxiliary pawl is positioned to permit movement of the auxiliary ratchet to its primary pawl disabling position, wherein the auxiliary pawl is biased towards the auxiliary ratchet holding position; a release lever moveable from a non-actuated position into an actuated position for moving the auxiliary pawl from its auxiliary ratchet holding position into its auxiliary ratchet releasing position; and a spring member interconnecting the release lever to the auxiliary ratchet to facilitate movement of the auxiliary ratchet from its primary pawl enabling position to its primary pawl disabling position when the release lever is moved from its non-actuated position into its actuated position.

In accordance with these and other aspects, the present disclosure is further directed to a closure latch assembly comprising: a primary ratchet movable between a striker capture position whereat the primary ratchet is positioned to retain a striker and a striker release position whereat the primary ratchet is positioned to release the striker, wherein the primary ratchet is biased towards its striker release position; a primary pawl movable between a ratchet holding position whereat the primary pawl is positioned to hold the primary ratchet in its striker capture position and a ratchet releasing position whereat the primary pawl permits the movement of the primary ratchet out of its striker capture position, wherein the primary pawl is biased towards its ratchet holding position; an auxiliary ratchet movable between a primary pawl enabling position whereat the auxiliary ratchet moves the primary pawl and then permits the primary pawl to be biased toward its ratchet holding position and a primary pawl disabling position whereat the auxiliary ratchet positions the primary pawl in its ratchet releasing position, wherein the auxiliary ratchet is biased towards its primary pawl disabling position; an auxiliary pawl movable between an auxiliary ratchet holding position whereat the auxiliary pawl is positioned to hold the auxiliary ratchet in its primary pawl enabling position and an auxiliary ratchet releasing position whereat the auxiliary pawl is positioned to permit movement of the auxiliary ratchet to its primary pawl disabling position, wherein the auxiliary pawl is biased towards the auxiliary ratchet holding position; a release lever moveable from a non-actuated position into an actuated position for moving the auxiliary pawl from its auxiliary ratchet holding position into its auxiliary ratchet releasing position; a resilient link arrangement interconnecting the release lever to the auxiliary ratchet; and a power actuator for moving the release lever from its non-actuated position into its actuated position to provide a power latch release operation and for moving the release lever from its actuated position to its non-actuated position to provide a power latch reset operation.

In one embodiment the closure latch assembly of the present disclosure is equipped with the resilient linkage arrangement configured as a spring member acting in a loaded state to assist during the power latch release operation, preferably when no or insufficient seal load is present to act on the auxiliary ratchet, to drive the primary pawl out of engagement with the primary ratchet and further acting in a rigid link state during the power latch reset operation to drive the auxiliary ratchet in conjunction with movement of the release lever.

In a related embodiment, the spring member is a torsion spring acting in its loaded state to drive the auxiliary ratchet toward its primary pawl disabling position and in its rigid link state to drive the auxiliary ratchet toward its primary pawl enabling state.

In accordance with another aspect, the torsion spring has a coiled segment supported on the release lever, a first end tang defining a first spring segment and engaging the release lever, and a second end tang defining a second spring segment and engaging the auxiliary ratchet.

In accordance with another aspect, the spring member is loaded to a pre-loaded state as the release lever moves relative to the auxiliary ratchet from its non-actuated position toward its actuated position, wherein the pre-loaded state of the spring member assists in moving the auxiliary ratchet toward its primary pawl disabling position during the power latch release operation, particularly when insufficient seal load between a closure member and a body of a motor vehicle is present.

In accordance with another aspect, the primary pawl can be pivotably mounted to the auxiliary ratchet.

In accordance with another aspect, a method of facilitating movement of a primary ratchet of a closure latch assembly from striker capture position to a striker release position during a release operation of the closure latch assembly is provided. The method includes: providing the closure latch assembly having a primary pawl movable between a ratchet holding position whereat the primary pawl is positioned to hold the primary ratchet in the striker capture position and a ratchet releasing position whereat the primary pawl permits the movement of the primary ratchet out of the striker capture position; an auxiliary ratchet movable between a primary pawl enabling position whereat the auxiliary ratchet permits the primary pawl to be biased toward its ratchet holding position and a primary pawl disabling position whereat the auxiliary ratchet positions the primary pawl in its ratchet releasing position; an auxiliary pawl movable between an auxiliary ratchet holding position whereat the auxiliary pawl is positioned to hold the auxiliary ratchet in its primary pawl enabling position and an auxiliary ratchet releasing position whereat the auxiliary pawl is positioned to permit movement of the auxiliary ratchet to its primary pawl disabling position; further, providing a release lever moveable from a non-actuated position into an actuated position for moving the auxiliary pawl from its auxiliary ratchet holding position into its auxiliary ratchet releasing position; and, operably connecting the release lever to the auxiliary ratchet with a spring member to facilitate movement of the auxiliary ratchet from its primary pawl enabling position to its primary pawl disabling position when the release lever is moved from its non-actuated position into its actuated position.

In accordance with another aspect, the method can include engaging a first spring segment of the spring member with the release lever and engaging a second spring segment of the spring member with the auxiliary ratchet.

In accordance with another aspect, the method can include coupling a coiled segment of the spring member to the release lever.

In accordance with another aspect, the method can include configuring the spring member to be loaded to a pre-loaded state as the release lever moves relative to the auxiliary ratchet from its non-actuated position toward its actuated position, wherein the pre-loaded state of the spring member assists in moving the auxiliary ratchet toward its primary pawl disabling position during the release operation.

In accordance with another aspect, the method can include configuring the spring member to hold the release lever in its actuated position during an initial stage of a latch reset operation whereat the release lever is returned to its non-actuated position.

In accordance with another aspect, the method can include providing the spring member as a torsion spring.

Further areas of applicability will become apparent from the description provided herein. The description and specific examples in this summary are intended for purposes of illustration only and are not intended to otherwise limit the full scope of the present disclosure.

BRIEF DESCRIPTION OF THE DRAWINGS

The drawings listed herein are intended to illustrate certain non-limiting embodiments of the present disclosure, wherein:

FIGS. 9A and 9B are generally similar to FIGS. 8A and 8B, respectively, but now illustrate further continuation (Phase III) of the power latch release operation, while

Corresponding reference numerals are used throughout the several views to indicate and identify corresponding parts.

DETAILED DESCRIPTION OF EXAMPLE EMBODIMENTS

Figure 1:
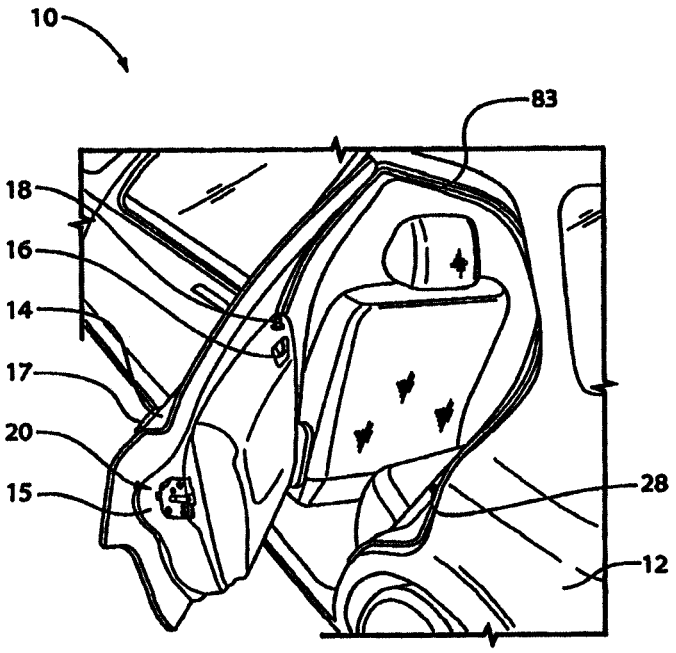
FIG. 1 is a partial isometric view of a motor vehicle having a closure member equipped with a closure latch assembly constructed in accordance with the present disclosure.

Example embodiments of a closure latch assembly are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure is directed to a closure latch assembly for use in motor vehicle closure systems. The closure latch assembly of the present disclosure, as discussed in detail hereafter, is equipped with a double pawl latch mechanism, including a primary pawl and an auxiliary pawl, and a power-operated latch release and reset mechanism that are operatively interconnected via a unique resilient linkage arrangement. This resilient linkage arrangement includes a spring member interconnecting a release lever upstream of the auxiliary pawl with the downstream auxiliary ratchet. The spring member acts as a link during both power latch release and power latch reset operations in response to movement of the upstream release lever to preload the spring member during a first stage portion of the power release operation in which the auxiliary pawl is moved to its auxiliary ratchet releasing position. Furthermore, movement of the primary pawl to its ratchet releasing position during latch release (i.e. the second stage of the power release operation) causes the pre-loaded spring member to exert a force on the auxiliary ratchet to assist in moving the primary pawl out of engagement with the primary ratchet, thereby facilitating release of the closure latch assembly.

FIG. 1 is an isometric view of a vehicle 10 including a vehicle body 12 and at least one vehicle closure member, identified hereinafter as vehicle door 14. Vehicle door 14 includes a closure latch assembly 20 that is positioned on an edge face 15 and which is releasably engageable with a striker 28 on vehicle body 12 to releasably hold vehicle door 14 in a closed position. An outside door handle 17 and an inside door handle 16 are provided for releasing closure latch assembly 20 (i.e. for releasing striker 28) to open vehicle door 14. An optional lock knob 18 is shown and provides a visual indication of the lock state of closure latch assembly 20 and may be operable to change the lock state between an unlocked position and a locked position.

Figure 2A:
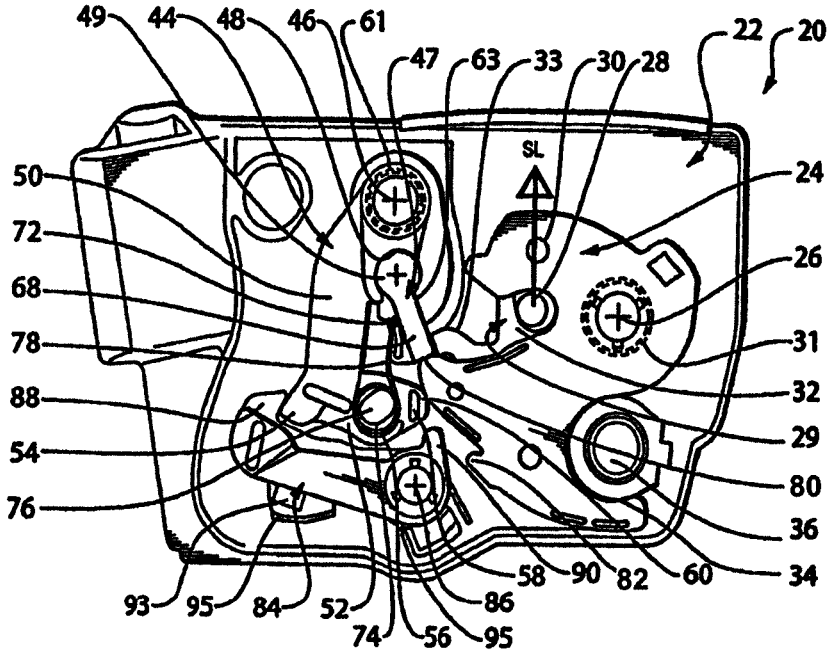
FIGS. 2A, 2B and 2C are plan views of various components of a double pawl latch mechanism and a power-operated latch release and reset mechanism associated with the closure latch assembly operating in a Latched mode.
Figure 2B:
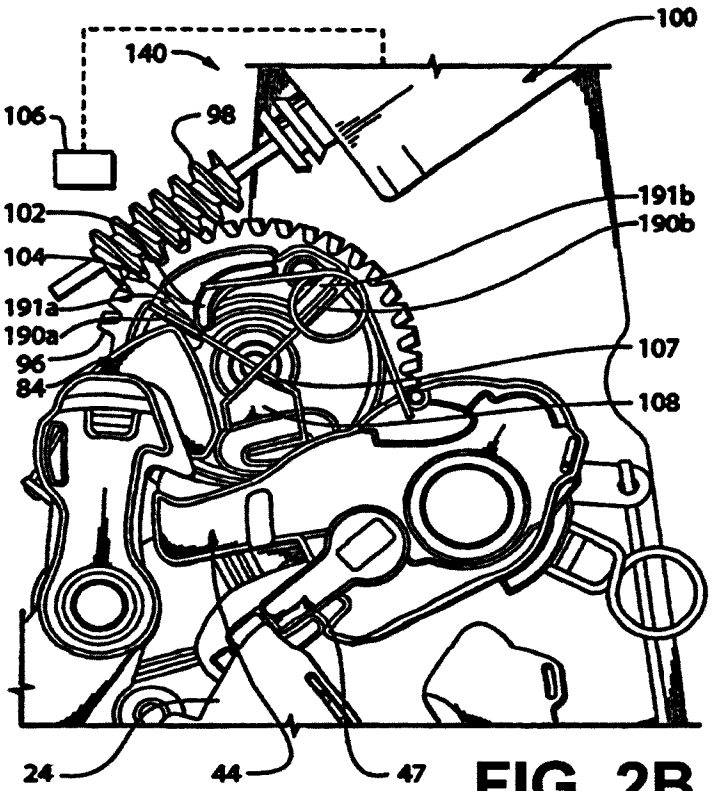

FIGS. 2A and 2B are views of closure latch assembly 20. Closure latch assembly 20 includes a housing 22 to which a primary ratchet 24 is pivotally mounted via a primary ratchet post 21 for rotation about a primary ratchet pivot axis 26. Primary ratchet 24 pivots between a fully-closed (i.e. "primary striker capture") position whereat striker 28 is captured in a slot 29 by a hook 30 of primary ratchet 24 (FIG. 2A) and an open (i.e. "striker released") position (FIG. 4B) whereat striker 28 is not trapped by hook 30 and is free to move out of slot 29 presented by primary ratchet 24. In the view shown in FIG. 2A, primary ratchet 24 rotates clockwise to move from its closed position to its open position.

Primary ratchet 24 is biased towards its open position via a primary ratchet biasing member 31. Biasing member 31 may be any suitable type of biasing member such as, for example, a torsion spring. A striker bumper 32 is mounted in housing 22 (underneath primary ratchet 24) to cushion against the striker force of impact and a ratchet bumper 34 is also mounted about a post 36 provided in housing 22 to cushion against the ratchet force of impact.

Figure 4A:
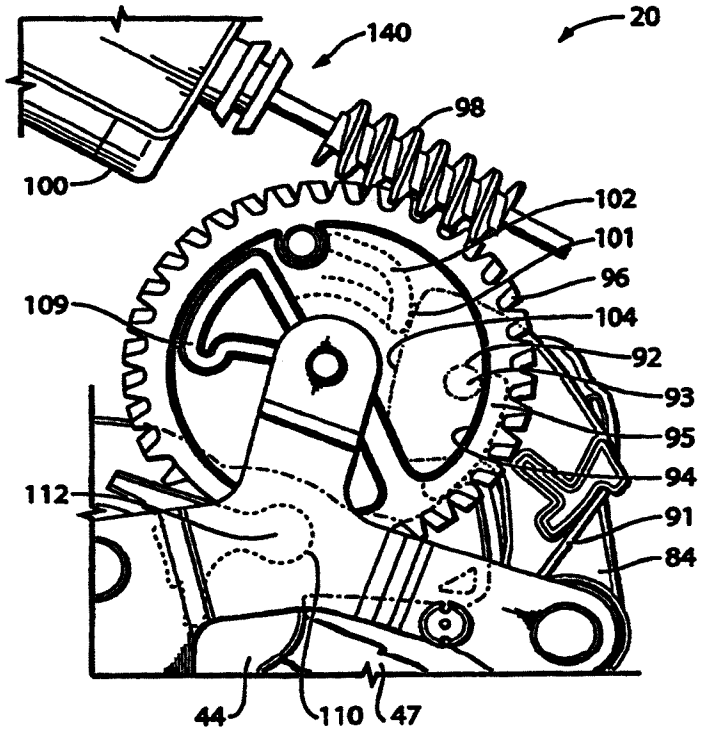
FIGS. 4A-4C are various illustrations showing a power release operation of the double pawl latch mechanism for shifting the closure latch assembly from its Latched mode into an Unlatched mode.
Figure 4B:
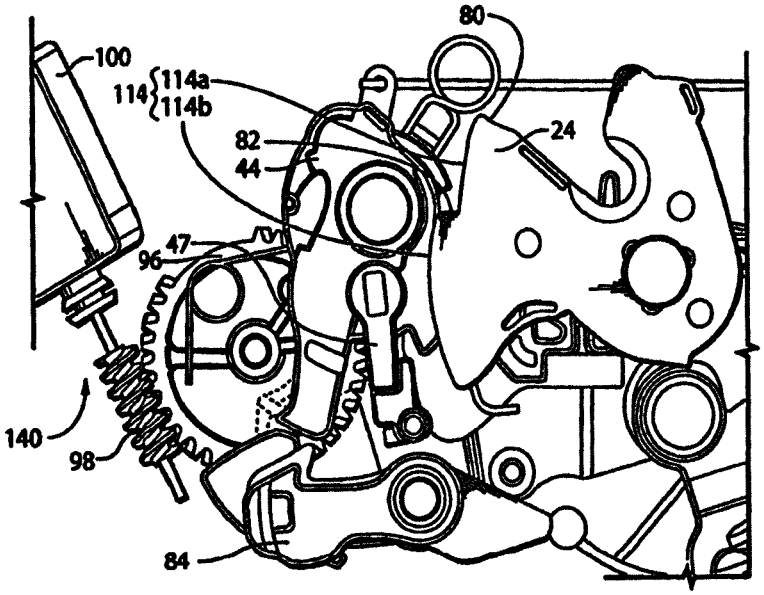

An auxiliary ratchet 44 is also pivotally mounted in housing 22 via an auxiliary ratchet post 45 for movement about an auxiliary ratchet pivot axis 46. A primary pawl 47 is operatively mounted to auxiliary ratchet 44, shown for example as being pivotally mounted to auxiliary ratchet 44 via a primary pawl joint 49, for movement about a primary pawl pivot axis 51. Auxiliary ratchet 44 is movable between a primary pawl enabling position (FIG. 2A) and a primary pawl disabling position (FIG. 4B). In its primary pawl enabling position, auxiliary ratchet 44 permits primary pawl 47 to move into a ratchet holding position whereat primary pawl 47 holds ratchet 24 in its closed position. In its primary pawl disabling position, auxiliary ratchet 44 prevents movement of primary pawl 47 to its ratchet holding position and instead holds primary pawl 47 in a ratchet releasing position, as is discussed in greater detail below. In the view shown in FIG. 2A, auxiliary ratchet 44 rotates clockwise to reach its primary pawl disabling position.

Auxiliary ratchet 44 includes a cylindrical bore 48 which receives a cylindrical stub segment of primary pawl 47 for pivotally mounting primary pawl 47 within the bore 48, thereby forming primary pawl joint 49. This provides a simple means for mounting primary pawl 47. Referring back to FIG. 2A, primary pawl 47 includes a check arm 68. With primary pawl 47 located in its ratchet holding position, check arm 68 engages and stops primary ratchet 24 from opening. In the view of FIG. 2A, primary pawl 47 rotates clockwise to move to its ratchet release position.

Auxiliary ratchet 44 also includes a leg segment 50 which, as shown in FIG. 2A, terminates in an anvil segment 52 having a check shoulder 54 and a cam lip 56. Auxiliary ratchet 44 may be encapsulated with an elastomeric material and features an optional hollow 58 so as to provide an elastically deformable band 60 for contacting and absorbing impact against primary ratchet 24. A variant of auxiliary ratchet shown in FIG. 2B does not include cam lip 56, band 60 and hollow 58. An auxiliary ratchet biasing member 61, located on the opposing side of housing 22, biases auxiliary ratchet 44 to its primary pawl enabling position. Only the hub portion of auxiliary ratchet biasing member 61 is shown in FIG. 2A, (and is shown in stippled lines), for simplicity. Biasing member 61 may include a first tang (not shown) that abuts a capstan of post 45 and a second tang which cooperates with a fork (not shown) in auxiliary ratchet 44 via a slot (not shown) formed in housing 22.

The angular sweep of check arm 68 of primary pawl 47 is limited on one side by an edge 63 in auxiliary ratchet 44 and on the other side by auxiliary ratchet leg segment 50. A proboscis bumper 72 formed from an encapsulation of primary pawl 47 may be provided to cushion impact of check arm 68 against auxiliary ratchet leg segment 50. An extension 33 of striker bumper 32 may be provided to reduce or cushion impact of check arm 68 against auxiliary ratchet edge 63.

Primary pawl 47 is biased towards its ratchet holding position by a primary pawl biasing member 74 wrapped around a post 76 provided in anvil segment 52 of auxiliary ratchet 44. One tang (not visible in FIG. 2A) of biasing member 74 rides against auxiliary ratchet leg 50 and another tang 78 abuts check arm 68 of primary pawl 47. Since primary pawl biasing member 74 is mounted to auxiliary ratchet 44 rather than being fixed to housing 22, the biasing forces on primary pawl 47 will not vary appreciably as auxiliary ratchet 44 rotates.

Primary ratchet 24 features primary and secondary latch surfaces 80 and 82 that interact with check arm 68 of primary pawl 47. Primary latch surface 80 provides the fully-closed (i.e. primary striker capture) position for primary ratchet 24 such that striker 28 is securely ensconced in slot 29 of primary ratchet 24 such that vehicle door 14 is completely closed and door seals 83 are compressed. Secondary latch surface 82 provides a partially-closed (i.e. "secondary striker capture") position of primary ratchet 24 wherein striker 28 is loosely secured in slot 29 of primary ratchet 24 such that vehicle door 14 is latched but not completely closed against door seals 83.

An auxiliary pawl 84 is pivotally mounted in housing 22 via an auxiliary pawl post 85 for movement about an auxiliary pawl pivot axis 86 between an auxiliary ratchet holding position whereat auxiliary pawl 84 holds auxiliary ratchet 44 in its primary pawl enabling position (FIG. 2A) and an auxiliary ratchet releasing position whereat auxiliary pawl 84 permits auxiliary ratchet 44 to move to its primary pawl disabling position. In the view shown in FIG. 2A, auxiliary pawl 84 rotates counterclockwise to reach its auxiliary ratchet releasing position. Auxiliary pawl 84 includes a hook shoulder 88 configured for engaging auxiliary check shoulder 54 on auxiliary ratchet 44. Auxiliary pawl 84 is biased towards its auxiliary ratchet holding position by an auxiliary pawl biasing member 91. Auxiliary pawl biasing member 91 may be any suitable type of biasing member, such as, for example, a torsion spring.

Figure 3:
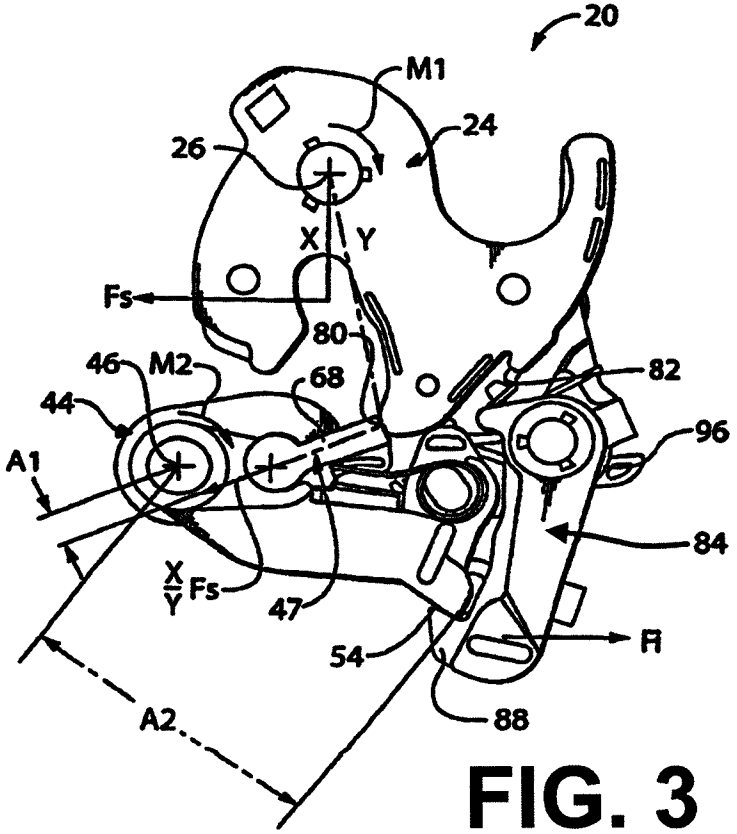
FIG. 3 is a plan view of the double pawl latch mechanism shown in FIGS. 2A-2C and illustrating forces acting on components thereof when the closure latch assembly is operating in its Latched mode.

It will thus be seen from the foregoing that closure latch assembly 20 provides an eccentric double pawl latch mechanism for lowering the latch release effort. More particularly, as illustrated in FIG. 3, there exists a force Fs on primary ratchet 24 that is a reaction to the seal force from door seals 83 when vehicle door 14 is closed. The force Fs along with the ratchet bias force presents a moment M1 on primary ratchet 24. The force necessary to move primary pawl 47 will thus be related to the coefficient of friction between check arm 68 and ratchet shoulder 80 multiplied by a force approximately X/Y of Fs, where X is the radial distance between the striker and the ratchet pivot axis 26 and Y is the distance between the primary pawl/ratchet contact area and the ratchet pivot point. In practice, the ratio X/Y could be about 40%. Similarly, the force X/Y*Fs applied to primary pawl 47 presents a moment M2 about auxiliary ratchet 44. The force necessary to move auxiliary pawl 84 will thus be related to the coefficient of friction between auxiliary pawl hook shoulder 88 and auxiliary ratchet check shoulder 54 multiplied by a force approximately A1/A2 of X/Y*Fs, where A1 is the radial distance between the force on primary pawl 47 and auxiliary ratchet pivot axis 46 and A2 is the radial distance between the auxiliary pawl/auxiliary ratchet contact area and the auxiliary ratchet pivot point. In practice, the ratio A1/A2 can be as low as 10-20%. Thus, a relatively low latch release effort may be required to shift closure latch assembly 20 from a Latched mode into an Unlatched mode.

Figure 2C:
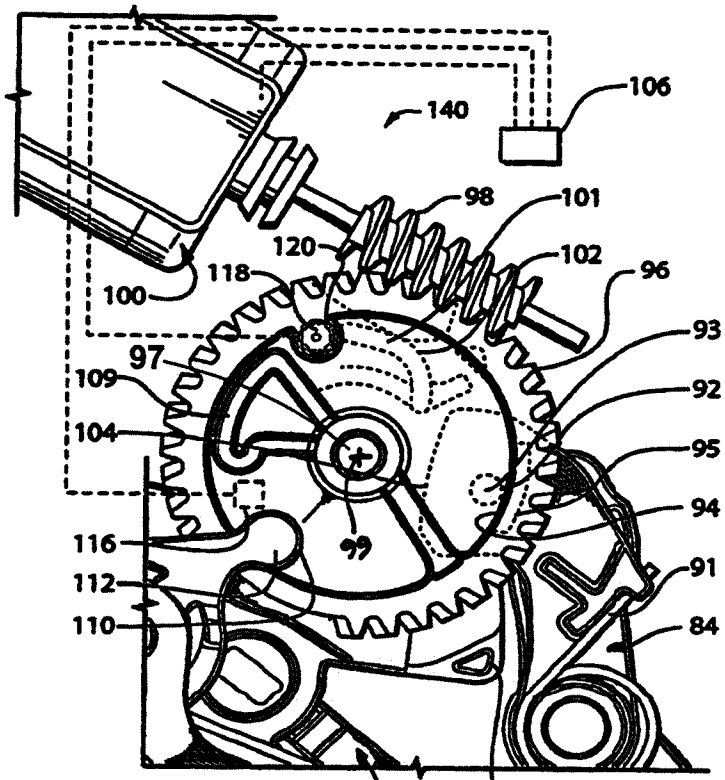
Figure 4C:
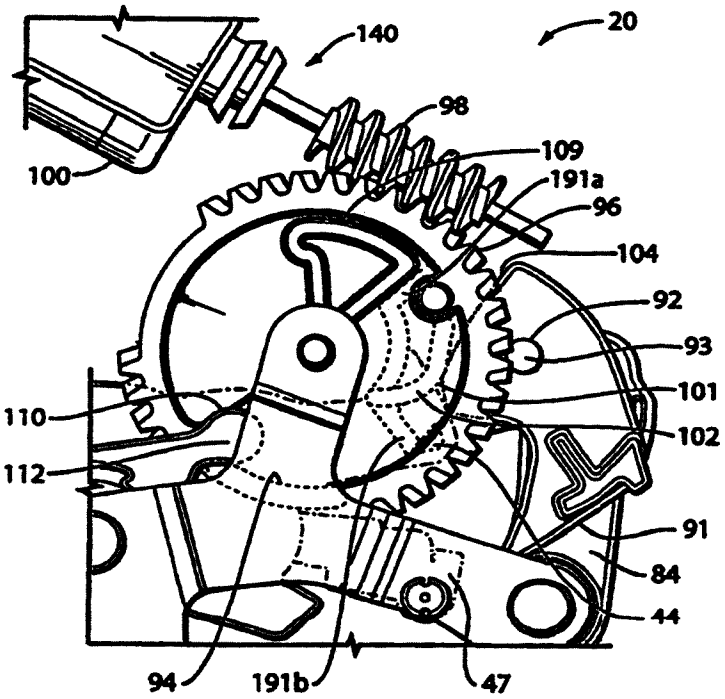

Referring to FIG. 2C, which is a view from the opposite side of closure latch assembly 20 to that which is shown in FIGS. 2A and 2B, auxiliary pawl 84 includes a first locking surface 92 formed on an auxiliary pawl locking projection 93. A second locking surface 94 is formed on a gear locking projection 95 which is provided on a gear 96. As shown in FIG. 2C, gear 96 is rotatably mounted to housing 22 via a gear post 97 for movement about a gear axis 99. Gear 96 is driven by a worm 98, which is itself driven by an electric motor 100. Gear 96 is movable (i.e. rotatable) between an auxiliary pawl locking position shown in FIG. 2C in which second locking surface 94 directly blocks (or otherwise cooperates with) the first locking surface 92 to prevent movement of auxiliary pawl 84 out of its auxiliary ratchet holding position, and an auxiliary pawl release position shown (FIG. 4C), in which second locking surface 94 is displaced from first locking surface 92 and thus permits auxiliary pawl 84 to move to its auxiliary ratchet releasing position.

Movement of gear 96 from its auxiliary pawl locking position (FIG. 2C) to its auxiliary pawl release position (FIG. 4C) may allow, when in a non-blocked position for example, auxiliary pawl 84 to move to its auxiliary ratchet releasing position under a normal operating condition e.g. when the primary ratchet 24 is urged to rotate under influence of the seal load SL (FIG. 2A) acting on striker 28 and/or may optionally cause, for example by interaction with auxiliary pawl 84 as described herein below in more detail, auxiliary pawl 84 to move to its auxiliary ratchet releasing position. Specifically, gear 96 may include a first gear drive surface 101 formed on a projection 102 that is engageable with an auxiliary pawl drive surface 104 formed on auxiliary pawl 84. When gear 96 is in its auxiliary pawl locking position (FIG. 2C), first gear drive surface 101 may be spaced from auxiliary pawl drive surface 104. As gear 96 moves from its auxiliary pawl locking position, gear 96 first reaches an auxiliary pawl unlocking position (FIG. 4A) in which second locking surface 94 moves out from engagement and blocking interaction with first locking surface 92.

After gear 96 reaches its auxiliary pawl unlocking position, further rotation of gear 96 causes first gear drive surface 101 to drive auxiliary pawl 84 out of its auxiliary ratchet holding position, until gear 96 reaches its auxiliary pawl release position (FIG. 4C), at which point first gear drive surface 101 has driven auxiliary pawl 84 to its auxiliary ratchet releasing position (against the biasing force of auxiliary pawl biasing member 91). This permits auxiliary ratchet 44 to move to its primary pawl disabling position under the biasing force imparted on auxiliary ratchet 44 by the seal load forces (SL) and auxiliary ratchet biasing member 61 and permits primary pawl 47 to move to its ratchet releasing position, which in turn permits primary ratchet 24 to move to its open position. The seal force Fs (e.g. SL) from door seals 83, assisted by the biasing force from primary ratchet biasing member 31, drive primary ratchet 24 under normal operation to its open position, thereby releasing striker 28 and opening vehicle door 14.

An electronic controller shown schematically at 106 in FIGS. 2B and 2C may be provided and be operatively connected to motor 100 for selectively supplying power to motor 100 to drive motor 100. Controller 106 may be dedicated to closure latch assembly 20 or may be part of some other controller for the vehicle, such as a central ECU that is used to control several other functions in the vehicle including, for example, crash detection. Controller 106 may have any suitable structure, and may, for example, include a processor, memory and may contain code that permits controller 106 to control the operation of motor 100 and to carry out the other functions described herein.

To detect when gear 96 has reached its auxiliary pawl release position, a limit switch is provided (such as a "door open" switch, handle switch or both), to sense a current spike as a result of a component hitting a hard limit, or by reaching a specified time for applying power to a motor gear assembly 140. An embodiment employs a limit switch in conjunction with a timeout to avoid unnecessary power consumption. When controller 106 detects that gear 96 has reached its auxiliary pawl release position, controller 106 immediately rotates gear wheel 96 to a reset position (shown in FIGS. 5A and 5B) to shift closure latch assembly 20 into a reset mode whereat it is ready to receive and capture striker 28 upon return of striker 28 back into slot 29 or primary ratchet 24. To move gear 96 to the reset position, motor 100 drives gear 96, optionally in the opposite direction to the direction used to bring gear 96 to its auxiliary pawl release position. Rotation of gear 96 to its reset position causes movement of auxiliary ratchet 44 from its primary pawl disabling position to its primary pawl enabling position via engagement of a second gear drive surface 109 with an auxiliary drive surface 110 on an arm of a reset lever 112 that rotates about the same axis as the auxiliary ratchet 44 (i.e. axis 45). Reset lever 112 is engageable with auxiliary ratchet 44 by way of a reset lever spring (not shown) that acts between auxiliary ratchet 44 and reset lever 112, thereby providing some amount of lost motion with auxiliary ratchet 44. Thus, when gear 96 drives reset lever 112 (via engagement between surface 109 and surface 110), reset lever 112, in turn, drives auxiliary ratchet 44 through reset lever spring.

After driving auxiliary ratchet 44 to its primary pawl enabling position, further rotation of gear 96 to its reset position brings gear drive surface 104 away from auxiliary pawl 84, thereby permitting auxiliary pawl 84 to return to its auxiliary ratchet holding position so as to capture auxiliary ratchet 44 in its primary pawl enabling position. Alternatively, and as illustrated in FIGS. 13A-17A, auxiliary pawl 84' may be returned to its auxiliary ratchet holding position under influence of a bias e.g. auxiliary pawl biasing member 91', such as a spring, upon auxiliary ratchet 44' returning to its primary pawl enabling position as described in more detail herein below. Once gear 96 has reached its reset position, controller 106 may stop sending current to motor 100. As a result, a centering spring (FIG. 2B) surrounding a post 108 drives gear 96 to return to its secondary pawl locking position. In the example shown in FIG. 2B, centering spring 107 has a first tang 190*a* that engages a first tang receiving wall 191*a* on gear 96 and a second tang 190*b* that engages a second tang receiving wall 191*b* on the gear 96. For greater clarity a centering spring is a spring that permits movement of an object in either of two opposing directions away from a rest position, wherein regardless of which direction the object is moved in, centering spring 107 urges the object back towards the rest position.

Figure 5A:
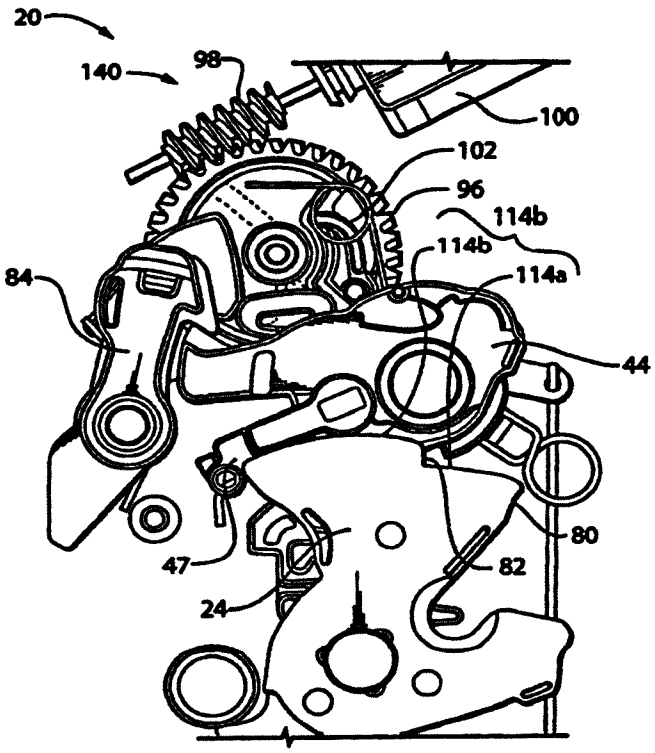
FIGS. 5A and 5B illustrate a power resetting operating of the double pawl latch mechanism for shifting the closure latch assembly into a Reset mode.

As can be seen in FIG. 5A, however, even though auxiliary ratchet 44 is in its primary pawl enabling position, primary pawl 47 is not in one of its ratchet holding positions. Instead, primary pawl 47 abuts a side edge 114 of primary ratchet 24, and not primary or secondary latch surfaces 80 and 82 respectively of primary ratchet 24, because primary ratchet 24 is itself still in its open position. Side edge 114 is divided into a first side edge portion 114*a* that extends between primary and secondary latch surfaces 80 and 82, and a second side edge portion 114*b* that continues from secondary latch surface 80 onwards. When closure latch assembly 20 is in its Reset mode as described above, closure latch assembly 20 is ready to receive and capture striker 28 when vehicle door 14 is closed.

Initially, in the reset position, primary pawl 47 abuts second side edge portion 114*b*. When vehicle door 14 is closed and striker 28 engages slot 29 of primary ratchet 24, striker 28 drives primary ratchet 24 to rotate (counterclockwise in the view shown in FIG. 5A) towards its fully-closed position. As secondary latch surface 82 sweeps past primary pawl 47, primary pawl 47 falls into contact with first side edge portion 114*a* (from the biasing force of biasing member 74). As primary ratchet 24 moves into its fully-closed position and primary latch surface 80 sweeps past primary pawl 47, primary pawl 47 moves into its ratchet holding position to prevent primary ratchet 24 from leaving its fully-closed position.

In operation, in its auxiliary ratchet holding position, auxiliary pawl 84 can be subject to an inertia force Fi (see FIG. 3) that may occur, for example, in the event of a vehicle crash. The force Fi, which does not need to be particularly high given the low release efforts required to open closure latch assembly 20 as discussed above, will urge auxiliary pawl 84 towards its auxiliary ratchet releasing position. However, the locking of auxiliary pawl 84 by locking surface 92 on gear 96 advantageously prevents secondary pawl 84 from pivoting into its auxiliary ratchet releasing position during a crash. By locking auxiliary pawl 84 in its auxiliary ratchet holding position directly with gear 96, the use of additional components is avoided.

Figure 5B:
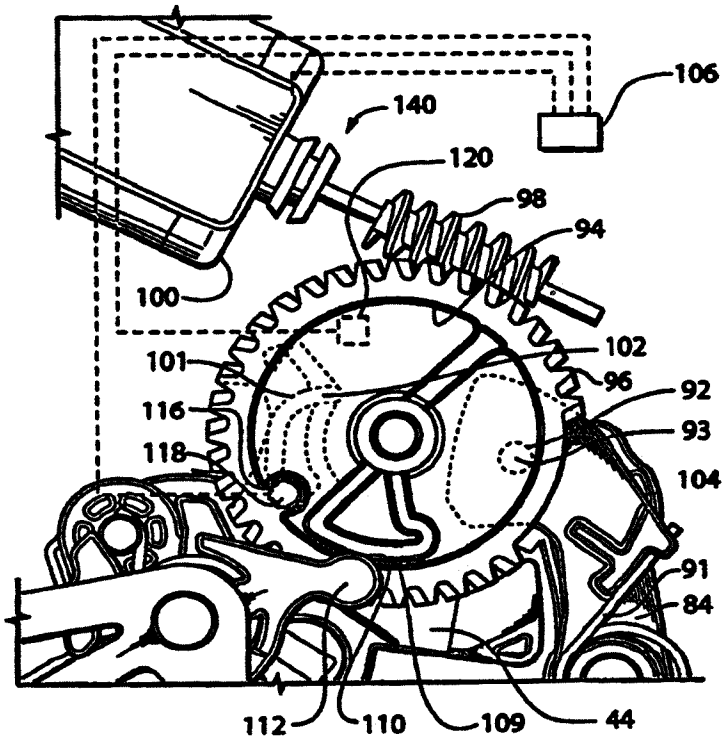

Referring to FIG. 5B, structure may be provided to verify that gear 96 has reached its reset position. For example, a first Hall-effect sensor shown at 116 may be provided and may be positioned (e.g. on housing 22) for sensing the presence of a magnet 118 positioned on gear 96 when gear 96 reaches its reset position. Sensor 116 may be referred to as a reset position sensor and may send signals to controller 106 that are indicative of whether gear 96 is in its reset position. Thus, when controller 106 attempts to drive gear 96 to its reset position, reset position sensor 116 can send a signal to controller 106 to indicate when gear 96 has reached its reset position. If, within a selected period of time after sending power to motor 100 to drive gear 96 to its reset position, controller 106 does not receive a signal indicating that gear 96 has reached its reset position, controller 106 may notify the vehicle driver of a problem with closure latch assembly 20. Notifying the vehicle driver of a problem with closure latch assembly 20 may, for example entail sending signals to an ECU in the vehicle.

In addition to sensing when gear 96 reaches its reset position, closure latch assembly 20 may be configured to sense when gear 96 reaches its auxiliary pawl locking position. For example, closure latch assembly 20 may include a second Hall-effect sensor 116, figuratively illustrated as block 120 electrically connected to controller 106, that may be referred to as an auxiliary pawl locking position sensor and that is positioned (e.g. on housing 22) for sensing the presence of magnet 118 when gear 96 reaches its auxiliary pawl locking position. After cutting power to motor 100 once gear 96 reaches its reset position, if controller 106 does not receive a signal from second Hall-effect sensor 120 indicating that gear 96 has reached its auxiliary pawl locking position under the biasing force of centering spring 107 within a selected period of time (e.g. a second selected period of time), controller 106 may send power to motor 100 to drive gear 96 to its auxiliary pawl locking position. Upon receiving a signal from second Hall-effect sensor 120 indicating that gear 96 has reached its auxiliary pawl locking position, controller 106 may cut power to motor 100. If, after a further period of time, controller 106 still does not receive a signal indicating that gear 96 has reached its auxiliary pawl locking position, controller 106 may notify the vehicle driver or may send a signal to an ECU in the vehicle indicating that there is a problem with closure latch assembly 20.

Thus, controller 106 carries out at least one action in the event that gear 96 does not reach its auxiliary pawl locking position after a selected period of time passes after the cutting of power to motor 100 is initiated. The at least one action is selected from the group of actions consisting of: notifying a driver of vehicle 10 of a problem with the latch; and sending power to motor 100 to drive gear 96 towards its auxiliary pawl locking position.

While sensors 116 and 120 are shown to be Hall-effect sensors, they may alternatively be any other suitable kind of sensor. For example, sensors 116 and 120 could be limit switches and magnet 118 could be replaced by a simple protrusion on gear 96 that closes the contacts on one of the limit switches when gear 96 reaches its reset or auxiliary pawl locking positions. Alternatively, sensor 116 may be a sensor to detect a current spike in the current supplied to motor 100 as gear 96 dead-ends at its reset position. In such an embodiment, structure would be provided to limit one end of the travel of gear 96 at the reset position, thereby generating the current spike in motor 100.

Referring now to FIGS. 6 through 17, an alternative non-limiting embodiment of a closure latch assembly 200 configured for use in motor vehicle 10 is illustrated and which is constructed to incorporate several unique and non-obvious features directed to advancing the art. Referring initially to FIGS. 6A through 6C, various components of closure latch assembly 200 will be disclosed to illustrate a double pawl latch mechanism 202 interconnected via a resilient linkage arrangement 204 to a power-operated latch release and reset mechanism 206. Due to the similarity of various components of double pawl latch mechanism 202 and power-operated latch release and reset mechanism 206 to components previously described in relation to closure latch assembly 20, such similar components will be hereinafter identified with a common reference number having a "primed" suffix.

Double pawl latch mechanism 200 is shown to generally include primary ratchet 24', primary ratchet biasing member 31', auxiliary ratchet 44', auxiliary ratchet biasing member (not shown), primary pawl 47', primary pawl biasing member 74', auxiliary pawl 84', and auxiliary pawl biasing member 91'. Primary ratchet 24' is again supported on primary ratchet post 21' for movement between its fully-closed (primary striker capture) position, its partially-closed (secondary striker capture) position, and its open (striker release) position and is configured to include primary latch surface 80', secondary latch surface 82, first side edge surface 114*a*' and second side edge surface 114*b*'. Primary ratchet biasing member 31' surrounds ratchet post 21' and is configured to normally bias primary ratchet 24' in a releasing (counterclockwise) direction toward its open position.

Auxiliary ratchet 44' is again supported on auxiliary ratchet post 45' for pivotal movement between its primary pawl enabling position and its primary pawl disabling position. The auxiliary ratchet biasing member (not shown) normally biases auxiliary ratchet 44' toward its primary pawl disabling position. Auxiliary ratchet 44' includes a raised boss cylindrical segment 208 having a bore 48' within which the cylindrical stub segment of primary pawl 47' is disposed, thereby forming primary pawl pivot joint 49'. As before, location of auxiliary ratchet 44' in its primary pawl enabling position functions to permit primary pawl 47' to move into its ratchet holding position. In contrast, location of auxiliary ratchet 44' in its primary pawl disabling position functions to prevent primary pawl 47' from moving into its ratchet holding position, thereby holding primary pawl 47' in its ratchet releasing position. Primary pawl biasing member 74' is again configured to normally bias primary pawl 47' toward its ratchet holding position.

In addition to cylindrical boss segment 208, auxiliary ratchet 44' is configured to include a leg segment 50' and an anvil segment 52' defining a check shoulder 54'. Auxiliary ratchet 44' is again preferably encapsulated with an elastomeric material. In addition to its cylindrical stub segment, primary pawl 47' is configured to include a check arm segment 68' arranged to selectively engage primary latch shoulder 80' on primary ratchet 24' for holding primary ratchet 24' in its fully-closed position when primary pawl 47' is located in its ratchet holding position (door 14 latched in fully-closed position) as well as to selectively engage secondary latch shoulder 82' on primary ratchet 24' for holding primary ratchet 24' in its partially-closed position when primary pawl 47' is located in its ratchet holding position (door 14 latched in its partially-closed position). The angular sweep of primary pawl 47' is limited on one side by check arm 68' engaging a raised lug segment 216 formed on auxiliary ratchet 44' and on an opposite side by check arm 68' engaging an edge surface 218 associated with boss segment 208. As seen, a torsion spring 220 is operably disposed between auxiliary ratchet 44' and a release lever 210 associated with power-operated latch release and reset mechanism 206. Torsion spring 220 includes a coiled segment, also referred to as coiled section 222, surrounding a cylindrical boss segment 224 of release lever 210, a first spring segment defined by a first end tang 226 engaging a spring retainer lug 228 formed on release lever 210, and a second spring segment defined by a second end tang 230 disposed within a spring retainer notch 232 formed on raised lug segment 216 of auxiliary ratchet 44'. As will be detailed, resilient linkage arrangement 204 is established between release lever 210 and auxiliary ratchet 44' via torsion spring 220 and this arrangement provides an advantage over other conventional closure latch assemblies by providing a linkage between dual pawl latch mechanism 202 and power-operated latch release and reset mechanism 206 that is operable to assist during both the power latch release and the power latch reset operations of latch mechanism 200.

Figure 6A:
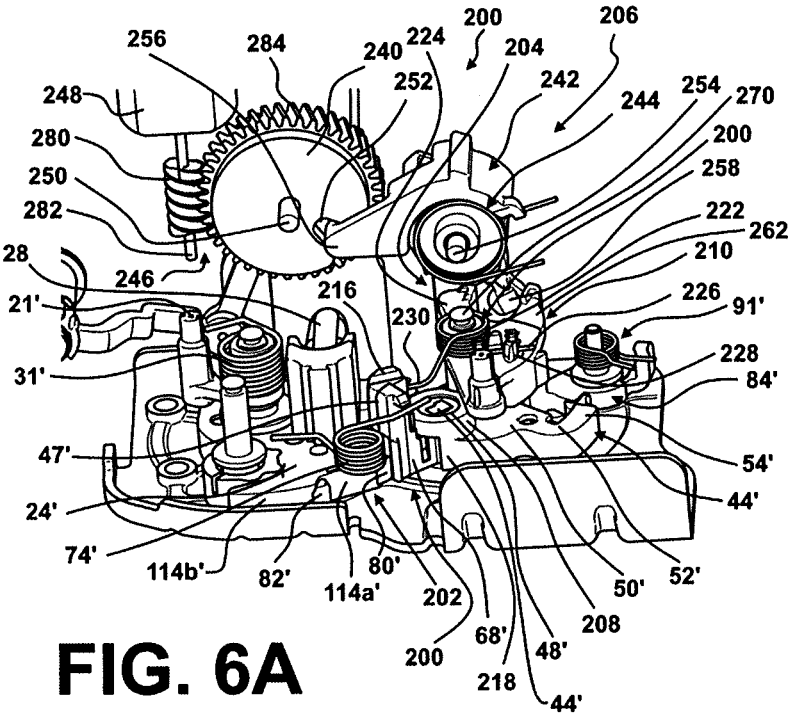
FIGS. 6A and 6B are isometric views and FIG. 6C is a top plan view of components associated with an alternative embodiment of a closure latch assembly constructed according to the present disclosure to include a double pawl latch mechanism interconnected via a resilient linkage arrangement to a power-operated latch release and reset mechanism, with the closure latch assembly shown operating in a Latched mode.
Figure 6B:
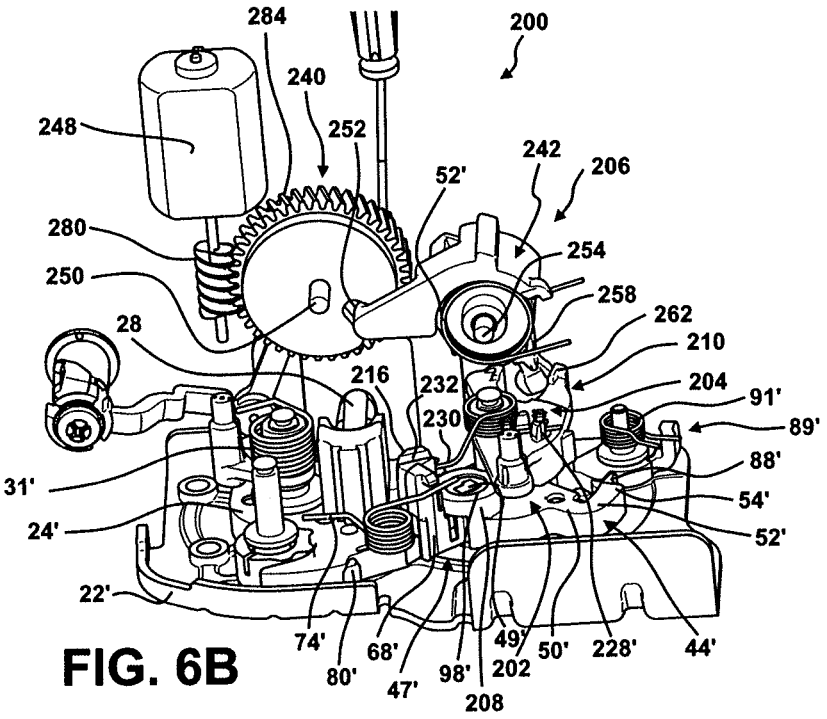
Figure 6C:
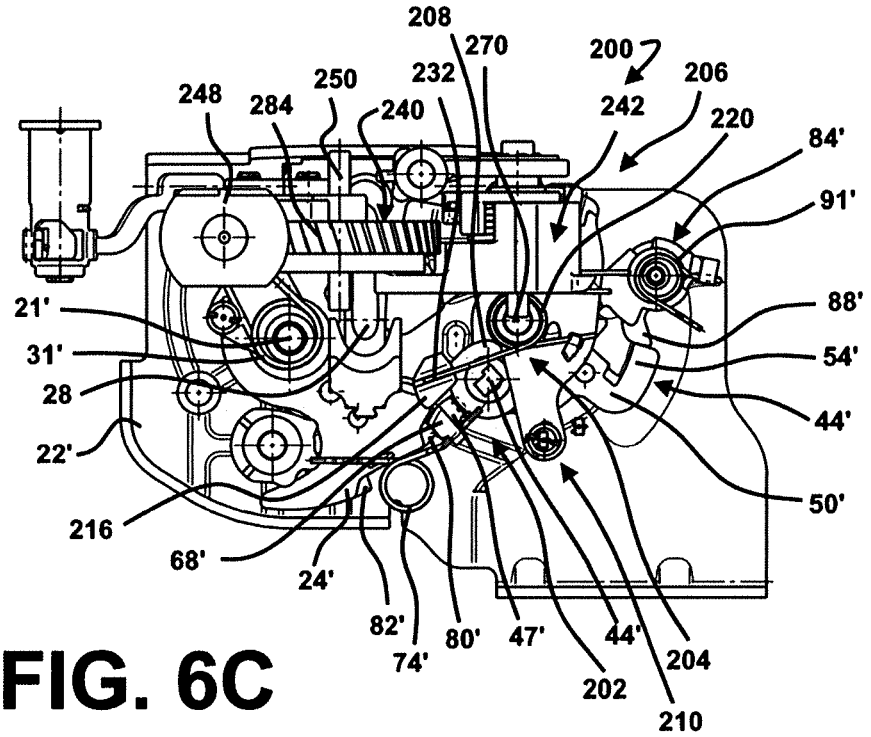

With continued attention to FIGS. 6A-6C, power-operated latch release and reset mechanism 206 is generally shown to include, in addition to release lever 210, a power release/reset (PR) gear 240, a gear lever 242, a gear lever spring 244, a geartrain 246, and an electric motor 248. PR gear 240 is supported in housing 22' for rotation about a gear post 250 and has a raised drive cam 252. Gear lever 242 is supported in housing 22' for rotation about a gear lever post 254 and includes a cam lug segment 256 and a release lever lug segment 258. Cam lug segment 256 of gear lever 242 is configured to continually engage drive cam 252 on PR gear 240 so as to coordinate concurrent movement therebetween. Release lever lug segment 258 of gear lever 242 is disposed within a lost-motion cavity formed in release lever 210 and defined between a latch release lug segment 260 and a latch reset lug segment 262. Release lever 210 is shown with boss segment 224 mounted on a release lever post 270.

PR gear 240 is shown located in a first or "home" position while gear lever 242 is shown located in a first or "non-actuated" position and release lever 210 is shown located in a first or "non-actuated" position. As shown, power-operated latch release and reset mechanism 206 is defined as operating in a non-actuated state when double pawl latch mechanism 202 is operating in a primary latched state with primary ratchet 24' held in its primary striker capture position, whereby the Latched mode for closure latch assembly 200 is established. Torsion spring 220 is configured to normally bias release lever 210 toward its non-actuated position while gear lever spring 244 is configured to normally bias gear lever 242 toward its non-actuated position. As best seen from FIGS. 6B and 6C, an end surface on hook shoulder 88' of secondary pawl 84' engages a complimentary end surface on check shoulder 54' of auxiliary ratchet 44' when auxiliary pawl 84' is located in its auxiliary ratchet holding position, thereby holding auxiliary ratchet 44' in its primary pawl enabling position. Geartrain 246 is shown to include a worm 280 driven by a motor shaft 282 of electric motor 248 with the threads of worm 280 meshed with gear teeth 284 formed on PR gear 240.

Figure 7A:
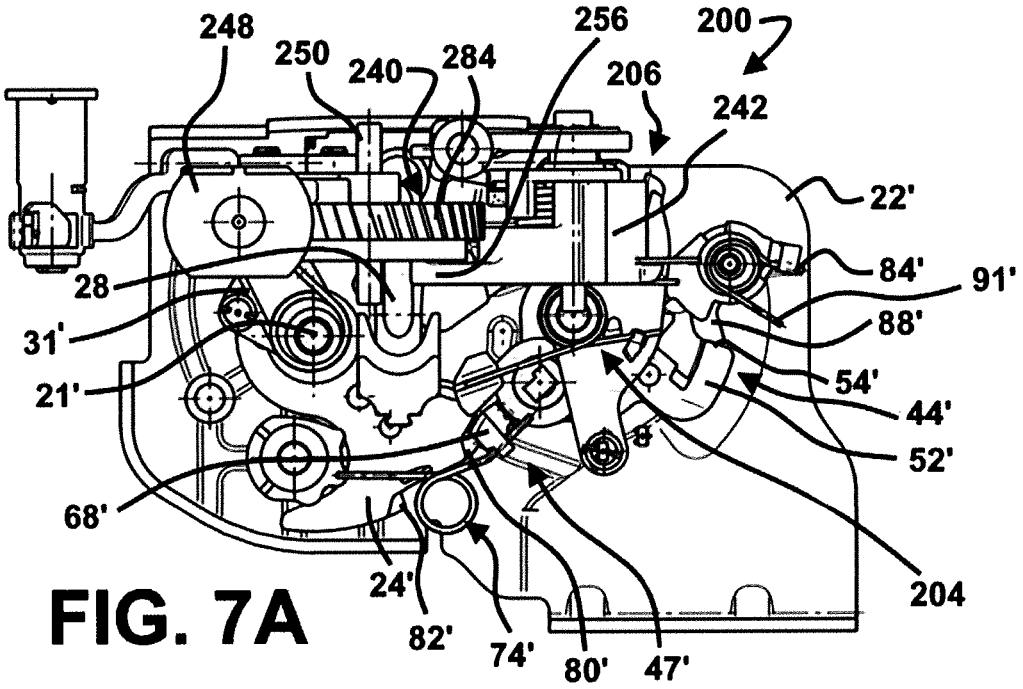
FIG. 7A is a top plan view and FIG. 7B is a corresponding isometric view showing initiation (Phase I) of a power latch release operation.
Figure 7B:
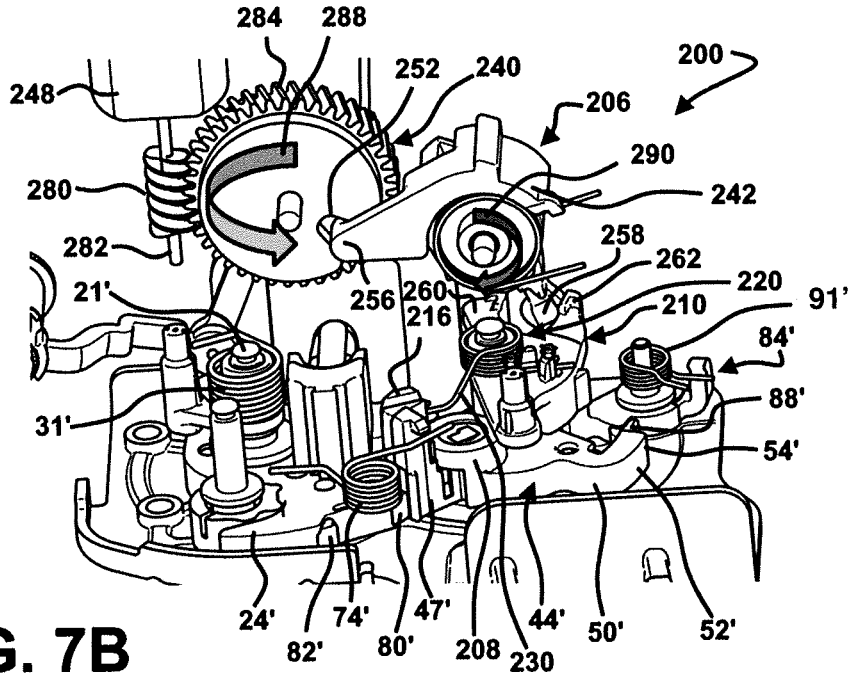

FIGS. 7A-7B through FIGS. 11A-11B are a series of sequential views of closure latch assembly 200 during the power release operation for shifting double pawl latch mechanism 202 from its primary latched state into a released state in response to power-operated latch release and reset mechanism 206 being shifted from its non-actuated state into an actuated state, whereby closure latch assembly 200 is shifted from its Latched mode into its Unlatched mode. To this end, FIGS. 7A and 7B illustrate initiation (Phase I) of the power latch release operation caused by electric motor 248 being energized to rotate PR gear 240 in a releasing (i.e. counterclockwise) direction for moving PR gear 240 from its home position toward a second or "latch released" position. FIG. 7B best illustrates that this initial rotation of PR gear 240 (indicated by arrow 288) causes concurrent rotation of gear lever 242 in an actuating (i.e. clockwise) direction (indicated by arrow 290) from its non-actuated position toward a second or "actuated" position, in opposition to the biasing of gear lever spring 244, due to engagement of drive cam 252 on PR gear 240 with cam lug segment 256 on gear lever 242. However, such initial movement of gear lever 242 does not cause concurrent movement of release lever 210 due to release lever lug segment 258 being located within the lost motion cavity of release lever 210. FIG. 7B illustrates a non-limiting amount of lost-motion travel for gear lever 242 in the amount of about 7° of pretravel, as but an illustrative example only.

Figure 8A:
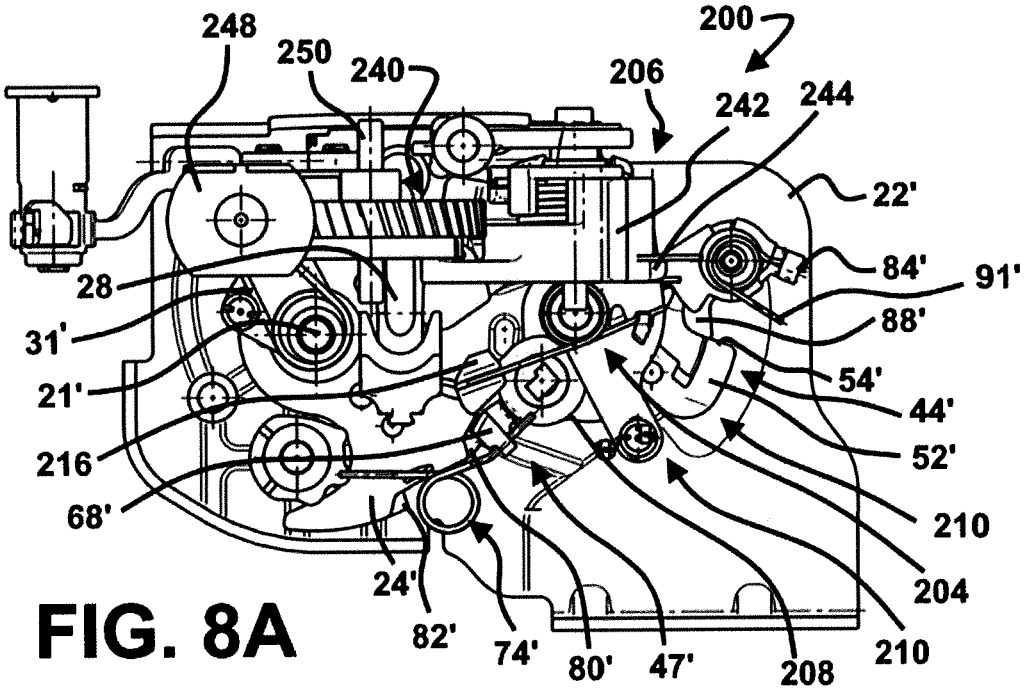
FIGS. 8A and 8B are generally similar to FIGS. 7A and 7B, respectively, but now illustrate continuation (Phase II) of the power latch release operation.
Figure 8B:
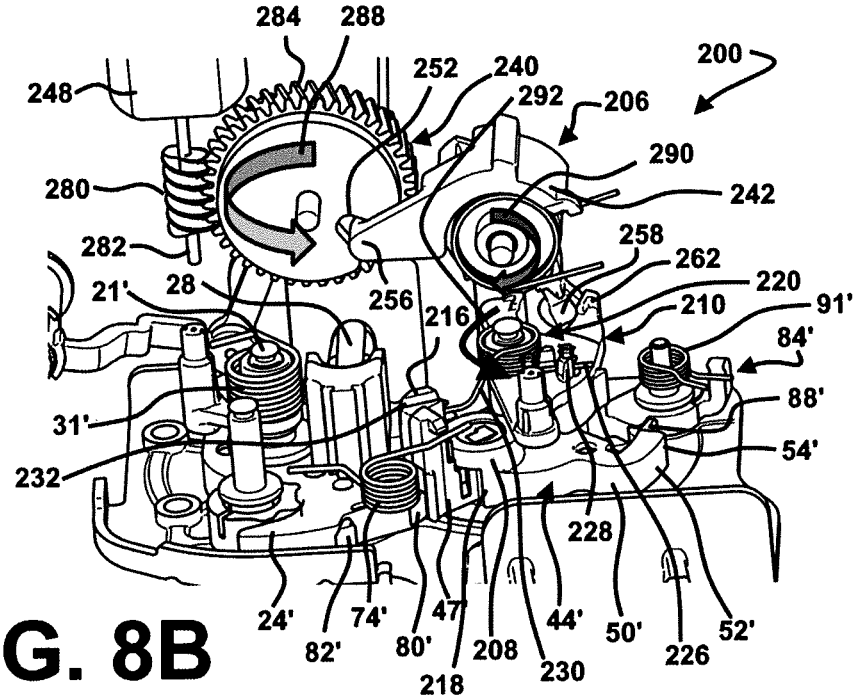

Referring to FIGS. 8A and 8B which are generally similar to FIGS. 7A and 7B, respectively, but now illustrate continuation (Phase II) of the power latch release operation. In particular, continued rotation of PR gear 240 in the releasing direction (arrow 288) causes continued rotation of gear lever 242 in the actuation direction (arrow 290) which, in turn, causes release lever 210 to start moving from its non-actuated position toward a second or "actuated" position. Specifically, release lever lug segment 258 on gear lever 242 engages latch release lug segment 260 for driving release lever 210 in a latch release direction (arrow 292). Such movement of release lever 210 toward its actuated position causes release lever 210 to engage and initiate rotation of auxiliary pawl 84' in a releasing (i.e. counterclockwise) direction for moving auxiliary pawl 84' from its auxiliary ratchet holding position toward its auxiliary ratchet releasing position, in opposition to the biasing of auxiliary pawl spring 91'. Since auxiliary ratchet 44' is maintained in its primary pawl enabling position until the auxiliary pawl 84' is in the auxiliary ratchet releasing position, torsion spring 220 is further loaded from an installed state in response to movement of release lever 210. As best seen from FIG. 9C, release lever 210 has an auxiliary pawl drive lug 298 configured to engage a driven lug 300 formed on auxiliary pawl 84' in response to movement of release lever 210 from its non-actuated position toward its actuated position. FIG. 8A also illustrates that such movement of auxiliary pawl 84' towards its auxiliary ratchet releasing position has almost resulted in its hook shoulder 88' becoming disengaged from check shoulder 54' on auxiliary ratchet 44'.

Figure 9A:
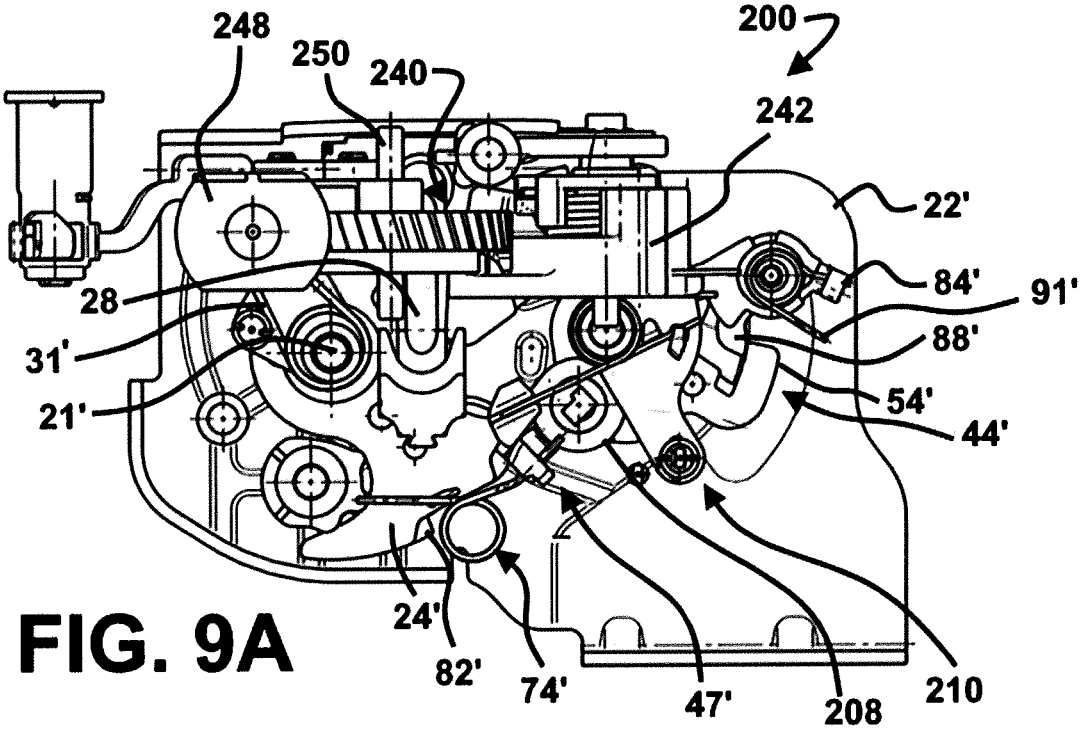
Figure 9B:
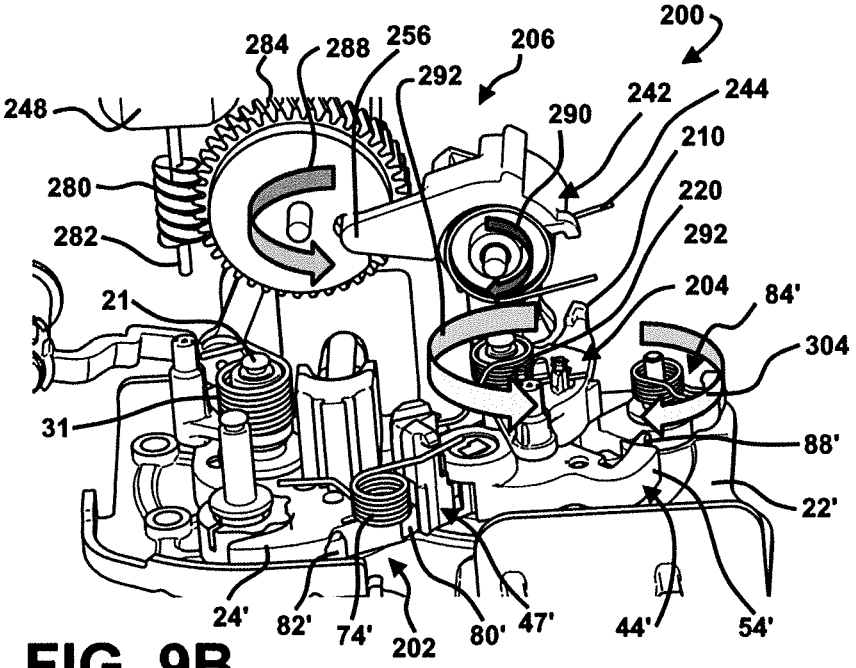
Figure 9C:
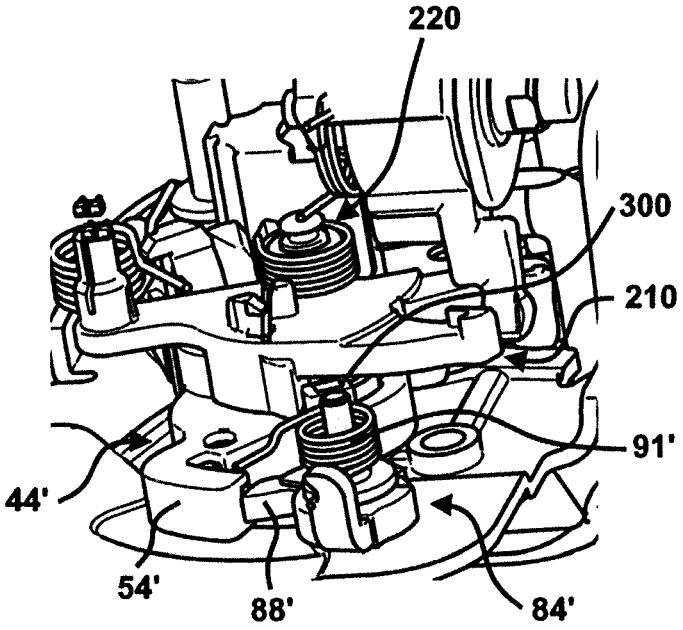
FIG. 9C is an enlarged partial isometric view showing the interaction between components of the latch mechanism and the power-operated latch release and reset mechanism.
Figure 10A:
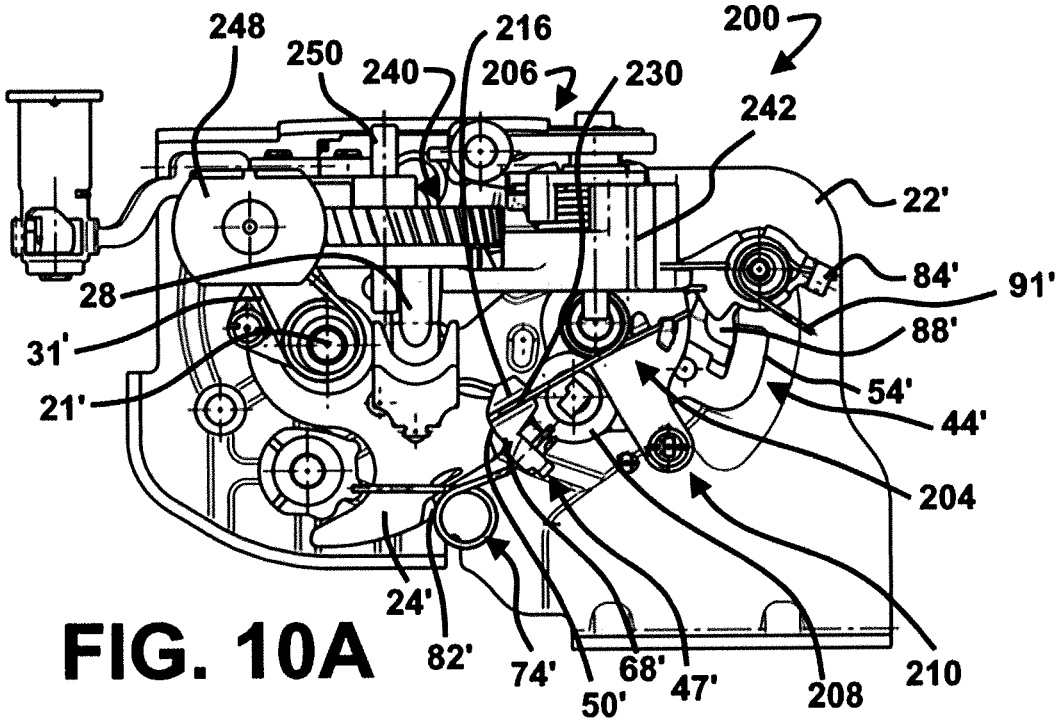
FIGS. 10A and 10B are generally similar to FIGS. 9A and 9B, respectively, but now illustrate still further continuation (Phase IV) of the power latch release operation.
Figure 10B:
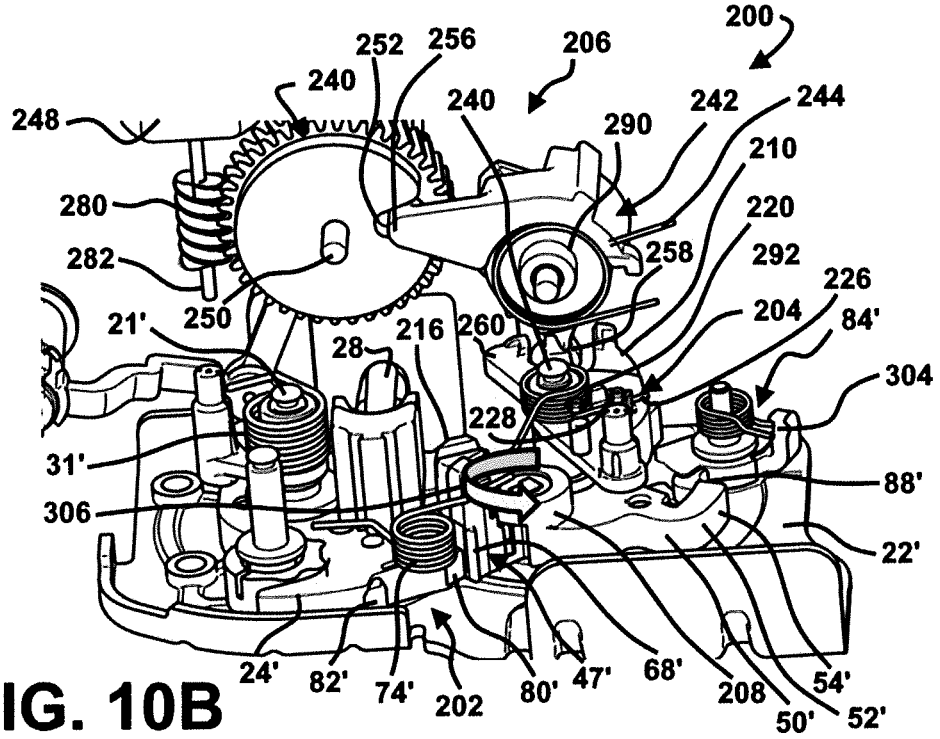

FIGS. 9A and 9B are generally similar to FIGS. 8A and 8B, respectively, but now show further continuation (Phase III) of the power latch release operation in response to combined rotation of PR gear 240 in the releasing direction towards its latch released position. As seen, this action results in release lever 210 continuing to drive auxiliary pawl 84' toward its auxiliary ratchet releasing position, as indicated by arrow 304. Specifically, FIG. 9A illustrates in the state whereby the seal load (SL) is insufficient, torsion spring 220 now capable of driving auxiliary ratchet 44' out of its primary pawl enabling position toward its primary pawl disabling position in response to hook shoulder 88' on auxiliary pawl 84' becoming disengaged from check shoulder 54' on auxiliary ratchet 44'. FIGS. 10A and 10B are similar to FIGS. 9A and 9B, respectively, but show still further continuation (Phase IV) of the power release operation with arrow 306 indicating seal load SL imparted movement, supplemented by spring-biased movement of auxiliary ratchet 44' towards its primary pawl disabling position due to the combined biasing of the auxiliary ratchet spring (not shown) and torsion spring 220. In these views, PR gear 240 has been rotated to its latch released position and motor 248 can now be turned off. As noted, the rotation of release lever 210 relative to auxiliary ratchet 44' before auxiliary pawl 84' reaches its auxiliary ratchet releasing position functions to load torsion spring 220. This "pre-loading" action permits torsion spring 220 to apply a force to auxiliary ratchet 44' toward its pawl disabling position in addition to the main seal load force (Fs), once auxiliary pawl 84' is disengaged from auxiliary ratchet 44'. FIGS. 10A and 10B clearly illustrate initial disengagement of check arm 68' of primary pawl 47' from primary latch shoulder 80' on primary ratchet 24' in response to movement of auxiliary ratchet 44' toward its pawl disabling position.

Figure 11A:
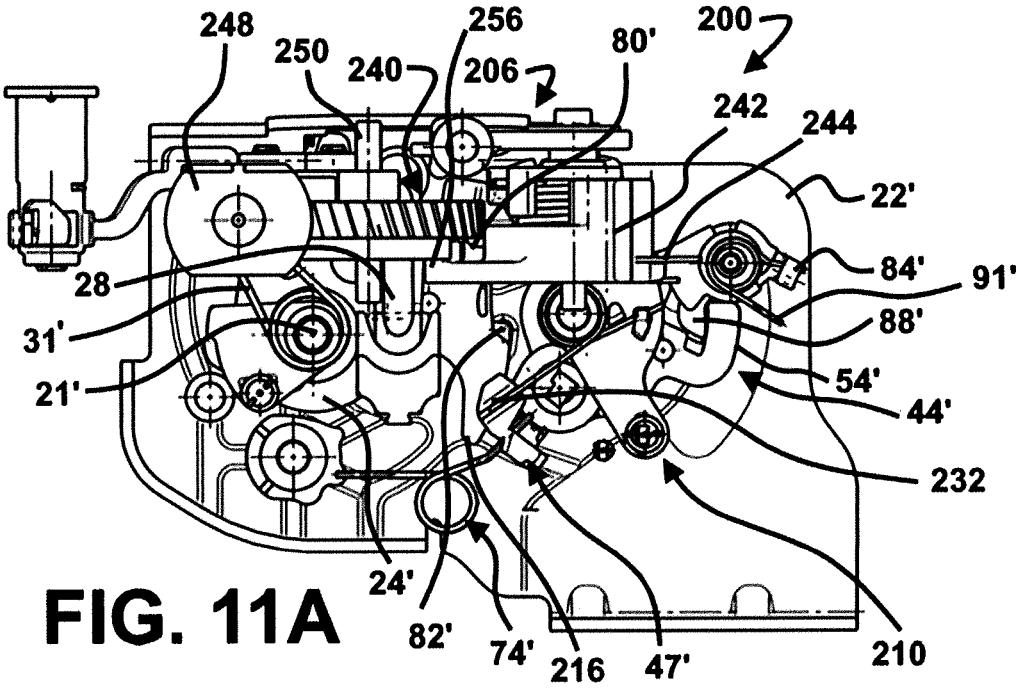
FIGS. 11A and 11B are generally similar to FIGS. 10A and 10B, respectively, but now illustrate yet further continuation (Phase V) of the power latch release operation.
Figure 11B:
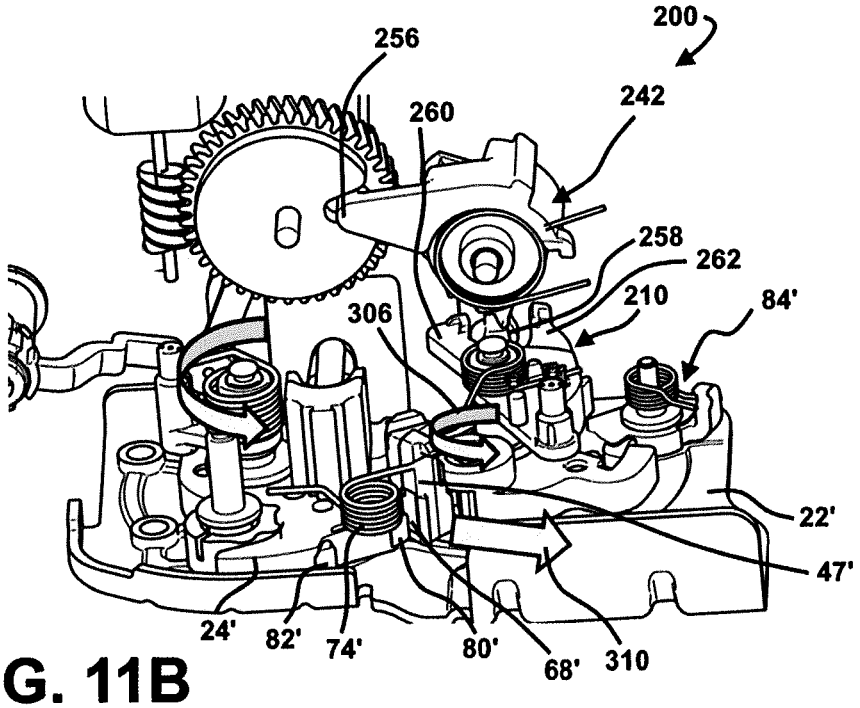
Figure 12:
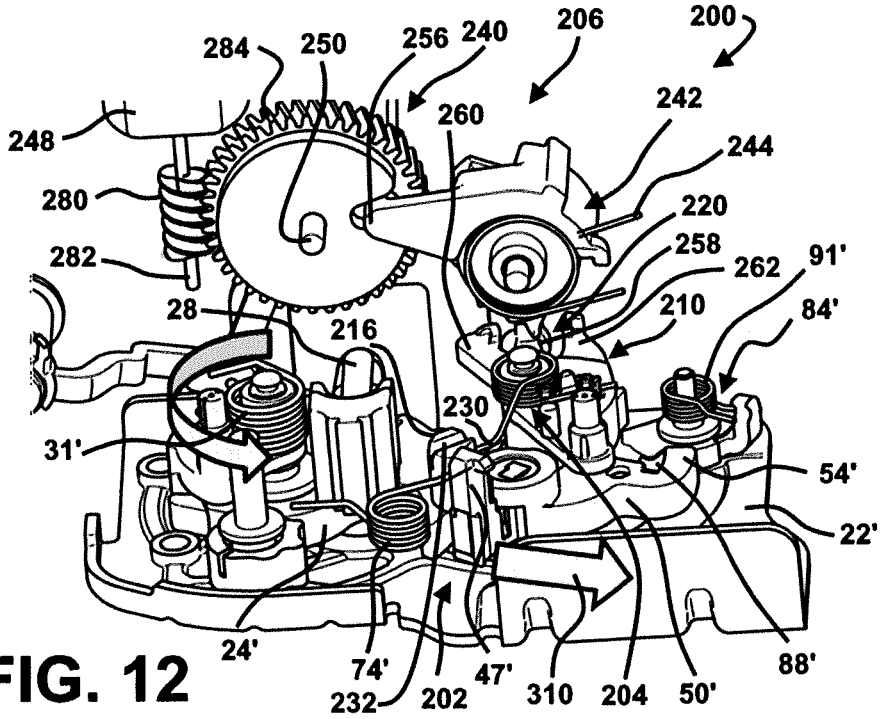
FIG. 12 is generally similar to FIG. 11B and illustrates completion (Phase VI) of the power release operation with the closure latch assembly operating in an Unlatched mode.

FIGS. 11A and 11B are generally similar to FIGS. 10A and 10B, respectively, but show further continuation (Phase V) of the power release operation with primary pawl 47' released from primary latch shoulder 80', as indicated by arrow 310. Specifically, PR gear 240 is located in its latch released position, gear lever 242 is held by PR gear 240 in its actuated position, release lever 210 is held by gear lever 242 in its actuated position, and auxiliary pawl 84' is held by release lever 210 in its auxiliary ratchet releasing position. Under normal operation, the seal load (SL) drives auxiliary ratchet 44' to its primary pawl disabling position which, in turn, functions to drive primary pawl 47' to its ratchet releasing direction. During such normal operation, torsion spring's 220 assistance in driving the auxiliary ratchet 44' is negligible or insignificant. In an operation where the seal load (SL) is insufficient to drive auxiliary ratchet 44' to its primary pawl disabling position, torsion spring 220 assists in driving auxiliary ratchet 44' to its primary pawl disabling position which, in turn, functions to drive primary pawl 47' to its ratchet releasing direction. Thus, ratchet spring 31' is free to rotate primary ratchet 24' from its primary striker capture position into its striker release position. Accordingly, power-operated latch release and reset mechanism 206 has been shifted into its actuated state for causing double pawl latch mechanism 202 to be shifted into its released state such that closure latch assembly 200 is now operating in its Unlatched mode. FIG. 12 illustrates primary ratchet 24' rotated to its striker release position to allow subsequent release of striker 28 therefrom and is indicated as completion (Phase VI) of the power latch release operation.

As noted, FIGS. 7 through 12 provide a set of sequential views which clearly show the power latch release operation. More importantly, these views illustrate a resilient linkage provided between a release component associated with latch release and reset mechanism 206 and a component associated with double pawl latch mechanism 202. This relationship provides a reset/release kinematic chain configured to act on secondary pawl 84' and primary pawl 47'. By providing an engagement of auxiliary components with main components of double pawl latch mechanism 202, closure latch assembly 200 provides an improved releasing operation compared to conventional arrangements.

Referring now to FIGS. 13-17, a power latch reset operation for closure latch assembly 200 will now be described. The power latch reset operation is initiated immediately following release of double pawl latch mechanism 202 at the conclusion of the power latch release operation. FIGS. 13A and 13B illustration initiation (Phase I) of the power latch reset operation in response to electric motor 248 driving PR gear 240 in a resetting (i.e. clockwise) direction (arrow 320) from its latch released position back toward its home position. Such rotation of PR gear 240 results in concurrent rotation of gear lever 242 from its actuated position back towards its non-actuated position (arrow 322) due to engagement between drive cam 252 on PR gear 240 and cam lug segment 256 on gear lever 242. Release lever 210 is initially held in its actuated position due to torsion spring 220 acting between it and auxiliary ratchet 44' which is located in its pawl disabling position. However, following a certain amount of pretravel (i.e. 7° of rotation) release lever lug 258 on gear lever 242 moves into engagement with latch reset lug 262 on release lever 210.

Figure 13A:
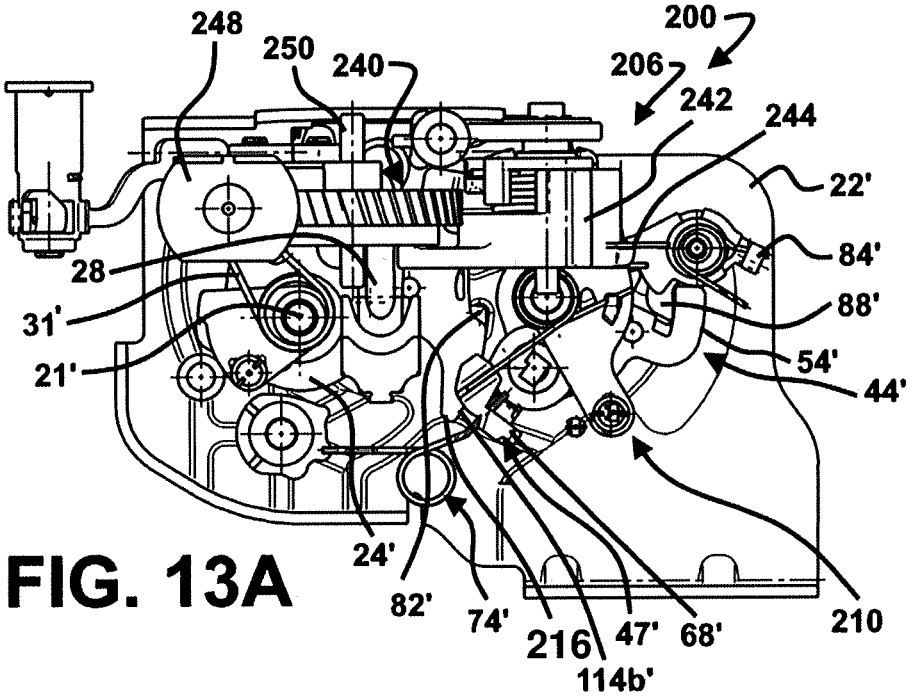
FIG. 13A is a top plan view and FIG. 13B is a corresponding isometric view showing initiation (Phase I) of a power latch reset operation following completion of the power latch release operation.
Figure 13B:
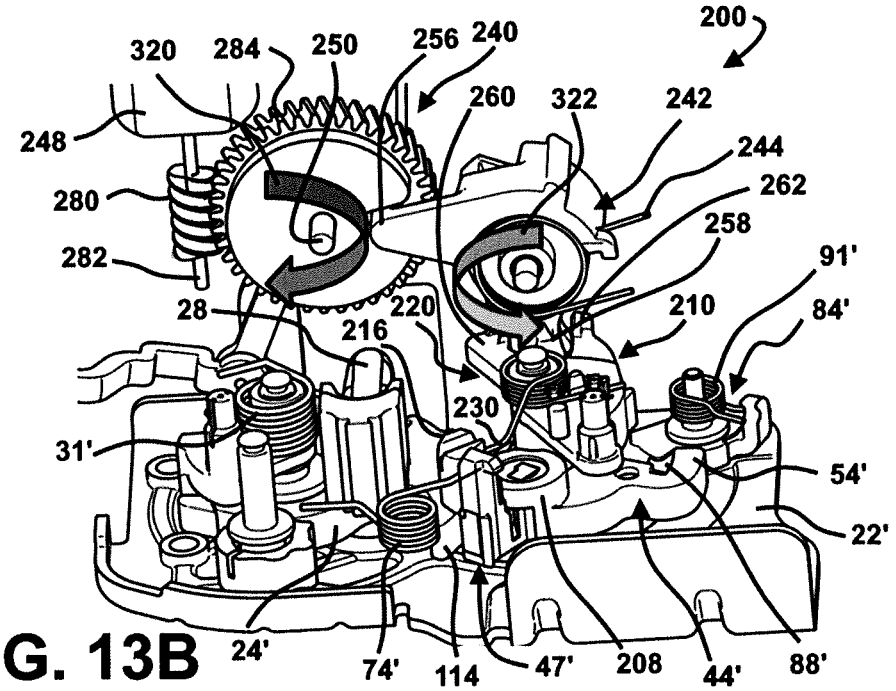
Figure 14A:
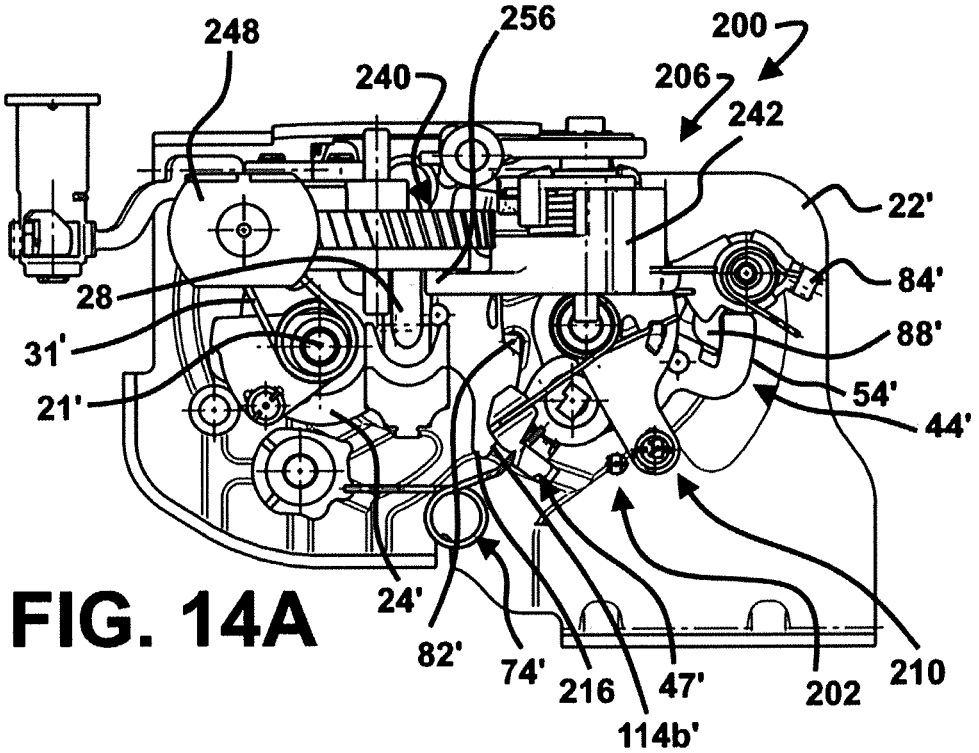
FIGS. 14A and 14B are generally similar to FIGS. 13A and 13B, respectively, but now illustrate continuation (Phase II) of the power latch reset operation.
Figure 14B:
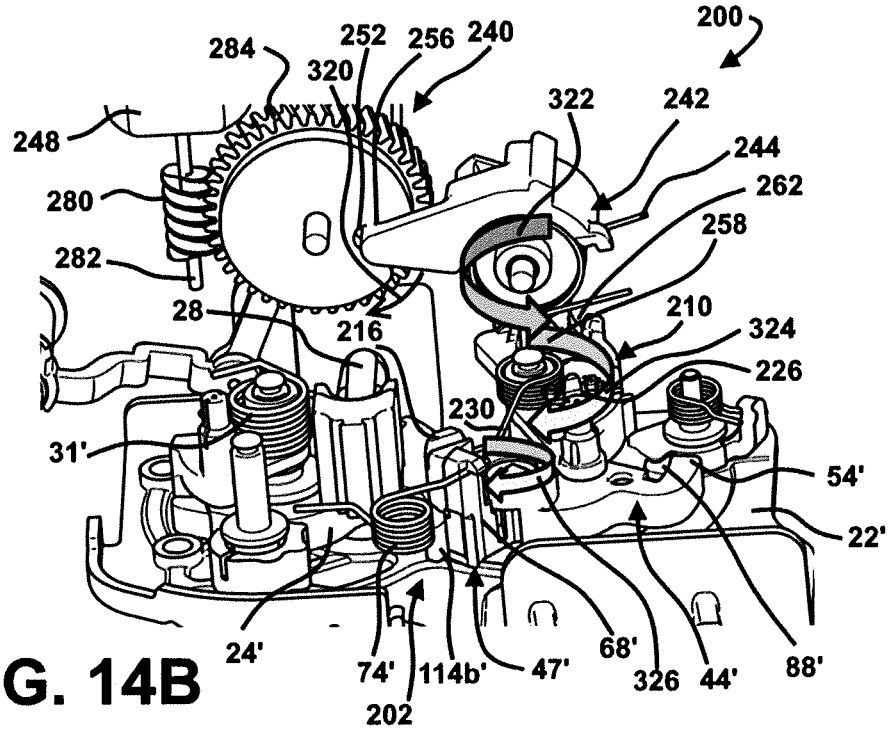

FIGS. 14A and 14B are generally similar to FIGS. 13A and 13B, respectively, but now show continuation (Phase II) of the power latch reset operation. As seen continued rotation of PR gear 240 in the resetting direction now causes gear lever 242 to drive release lever 210 from its actuated position back towards its non-actuated position (arrow 324). Torsion spring 220 acts as a link between release lever 210 and auxiliary ratchet 44' during the power latch reset operation, thereby causing auxiliary ratchet 44' to begin moving from its primary pawl disabling position back toward its primary pawl enabling position (arrow 326). Note also that hook 88' on auxiliary pawl 84' engages check shoulder 54' on auxiliary ratchet 44' such that auxiliary ratchet 44 prevents auxiliary pawl spring 91' from moving auxiliary pawl 84' back toward its auxiliary ratchet holding position.

Figure 15A:
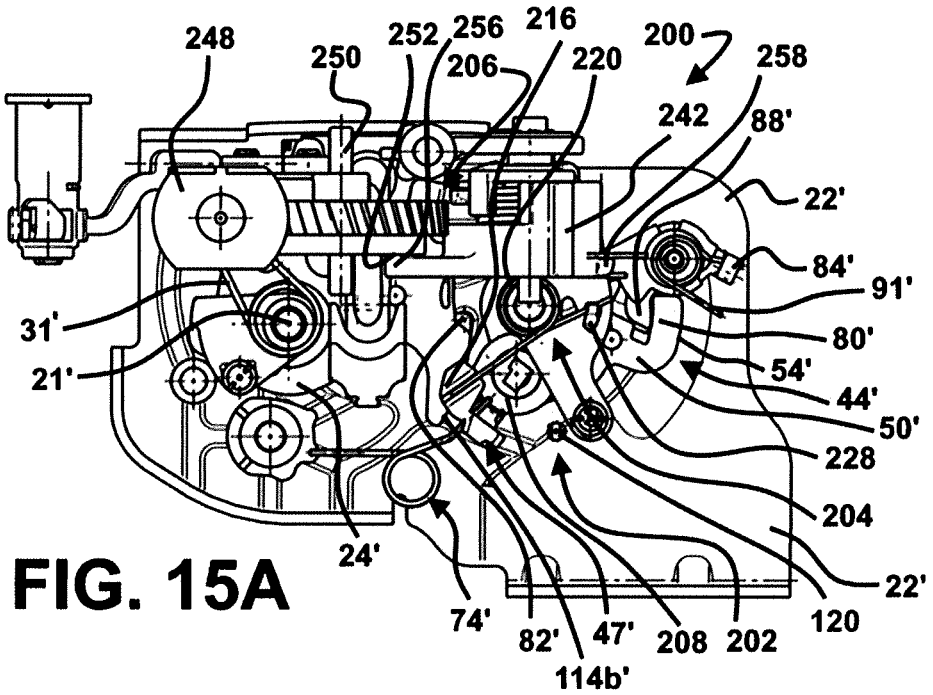
FIGS. 15A and 15B are generally similar to FIGS. 14A and 14B, respectively, but now illustrate further continuation (Phase III) of the power latch reset operation.
Figure 15B:
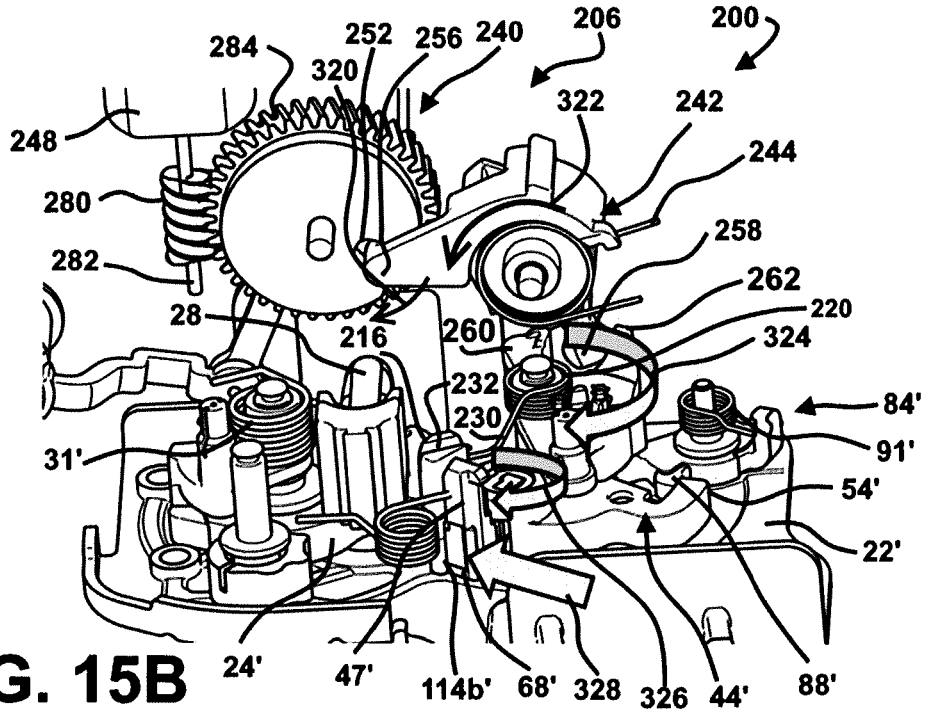

FIGS. 15A and 15B are generally similar to FIGS. 14A and 14B, respectively, but now show further continuation (Phase III) of the power latch reset operation. As seen, movement of auxiliary ratchet 44' back toward its primary pawl enabling position (arrow 326), due to its linkage via torsion spring 220 to release lever 210, now causes primary pawl 47' to move into engagement with side edge **114*b*' of primary ratchet 24' (arrow 328). Note that primary pawl spring 74' functions to bias primary pawl 47' into engagement with lug 216 on auxiliary ratchet 44'**.

Figure 16A:
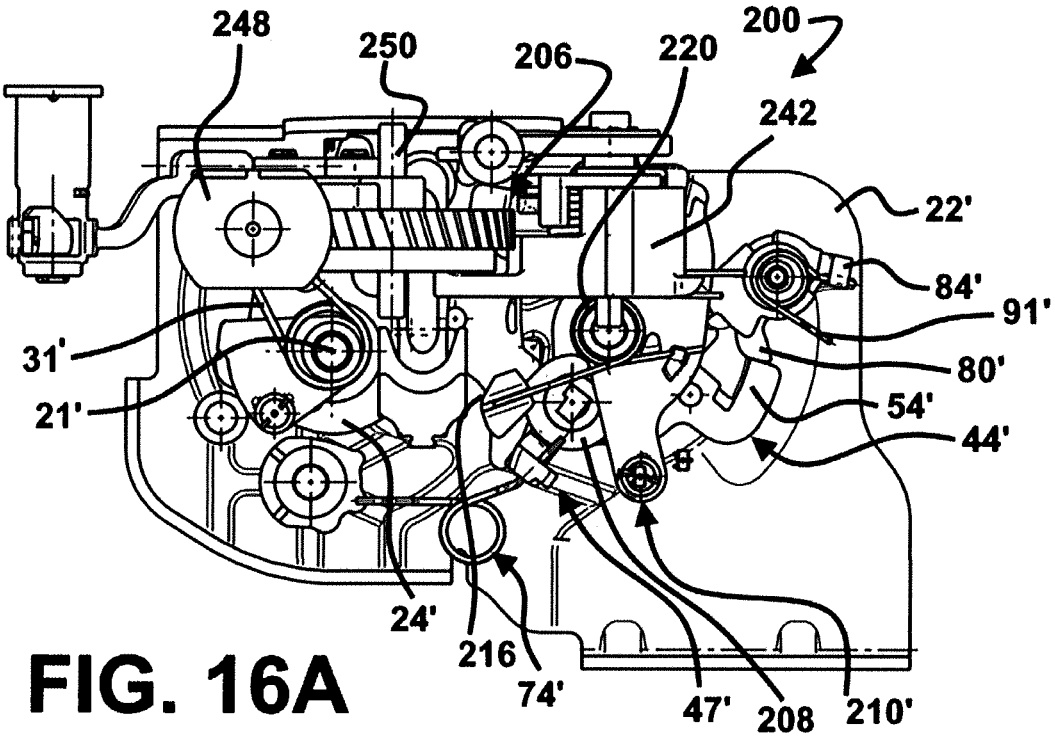
FIGS. 16A and 16B are generally similar to FIGS. 15A and 15B, respectively, but now illustrate still further continuation (Phase IV) of the power latch reset operation.
Figure 16B:
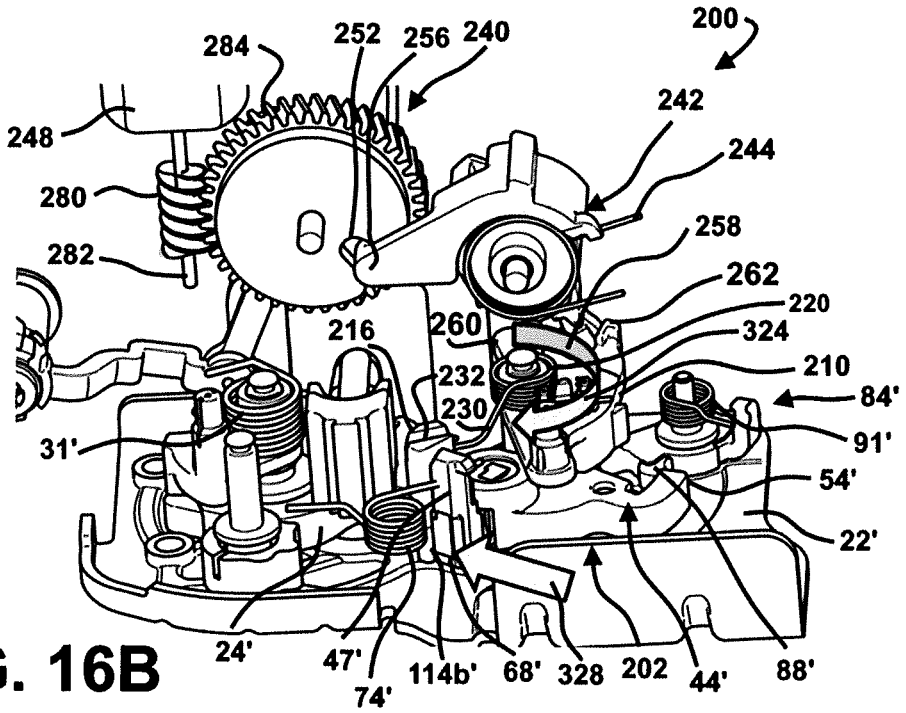

FIGS. 16A and 16B are generally similar to FIGS. 15A and 15B, respectively, but illustrate further continuation (Phase IV) of the power latch reset operation. Note that check shoulder 54' on auxiliary ratchet 44' continues to engage hook 88' on auxiliary pawl 84' so as to continue to prevent auxiliary pawl spring 91' from driving auxiliary pawl 84' back to its auxiliary ratchet holding position.

Figure 17A:
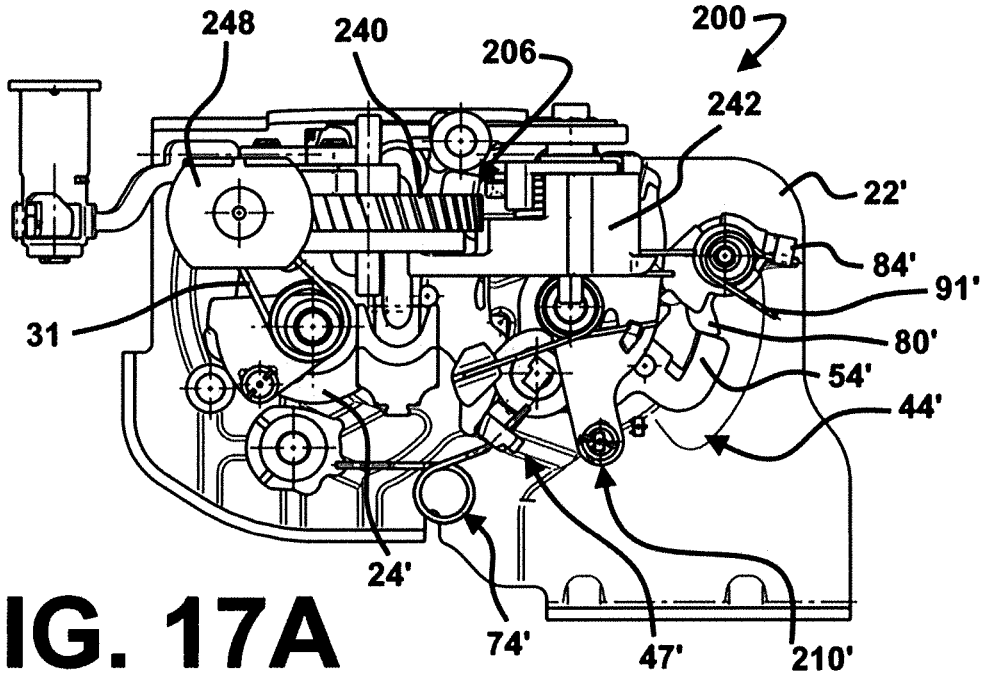
FIGS. 17A and 17B are generally similar to FIGS. 16A and 16B, respectively, but illustrate completion of the power reset operation with the closure latch assembly operating in a Reset mode.
Figure 17B:
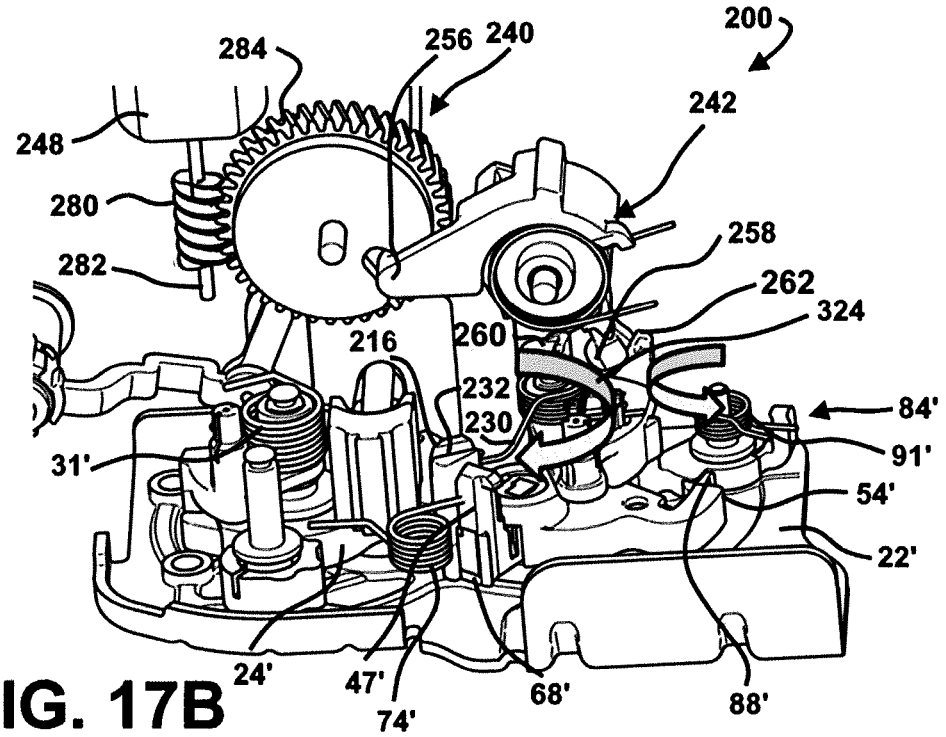

FIGS. 17A and 17B illustrate completion (Phase V) of the power latch reset operation with PR gear 240 located in its home position, gear lever 242 located in its non-actuated position, release lever 210 located in its non-actuated condition, and auxiliary pawl 84' located in its auxiliary ratchet holding position. With auxiliary pawl 84' located in its auxiliary ratchet holding position, auxiliary ratchet 44' is held in a reset position with primary pawl 47' biased against surface **114*b*' of primary ratchet 44'. Accordingly, closure latch assembly 200 is now in its Reset mode in preparation for shifting back into its Latched mode in response to door 14 being closed and striker 28 driving primary ratchet 24' from its striker released position into its primary striker capture position. By providing an engagement of auxiliary components with main components of double pawl latch mechanism 202, closure latch assembly 200** provides an improved reset operation with reduced noise as compared to conventional arrangements.

Figure 18:
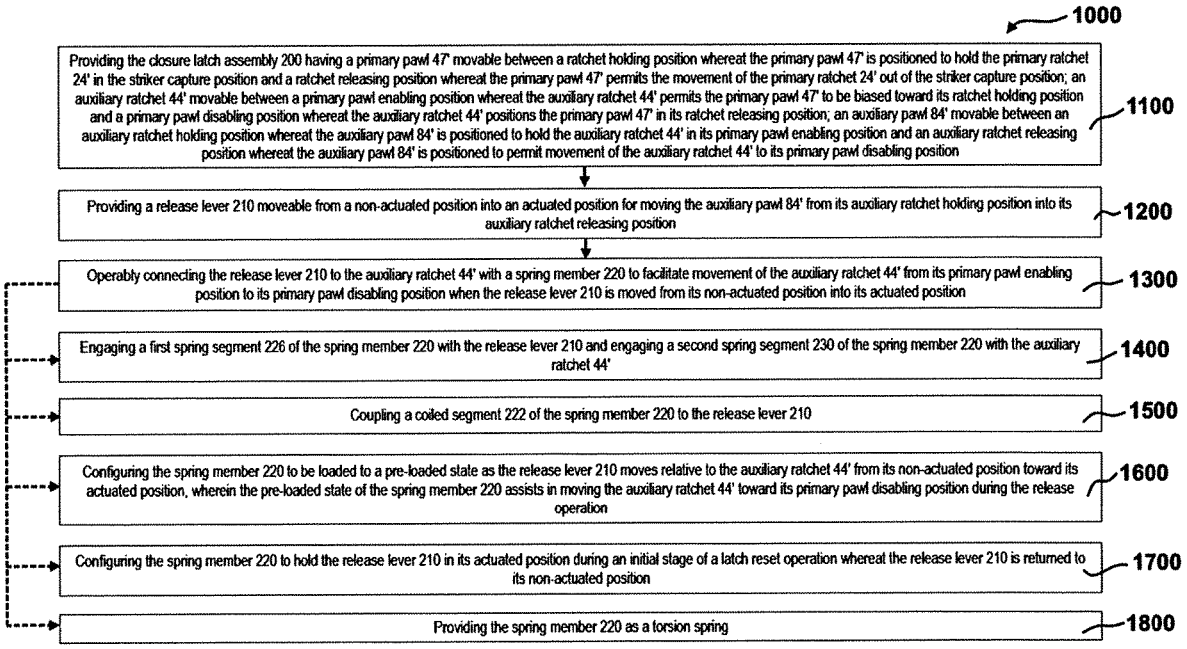
FIG. 18 is a flow diagram illustrating a method of facilitating movement of a primary ratchet of a closure latch assembly from striker capture position to a striker release position during a release operation of the closure latch assembly.

Finally, FIG. 18 illustrates a method 1000 of facilitating movement of a primary ratchet 24' of a closure latch assembly 200 from striker capture position to a striker release position during a release operation of the closure latch assembly 200. The method 1000 includes: a step 1100 of providing the closure latch assembly 200 having a primary pawl 47' movable between a ratchet holding position whereat the primary pawl 47' is positioned to hold the primary ratchet 24' in the striker capture position and a ratchet releasing position whereat the primary pawl 47' permits the movement of the primary ratchet 24' out of the striker capture position; an auxiliary ratchet 44' movable between a primary pawl enabling position whereat the auxiliary ratchet 44' permits the primary pawl 47' to be biased toward its ratchet holding position and a primary pawl disabling position whereat the auxiliary ratchet 44' positions the primary pawl 47' in its ratchet releasing position; an auxiliary pawl 84' movable between an auxiliary ratchet holding position whereat the auxiliary pawl 84' is positioned to hold the auxiliary ratchet 44' in its primary pawl enabling position and an auxiliary ratchet releasing position whereat the auxiliary pawl 84' is positioned to permit movement of the auxiliary ratchet 44' to its primary pawl disabling position; further, a step 1200 of providing a release lever 210 moveable from a non-actuated position into an actuated position for moving the auxiliary pawl 84' from its auxiliary ratchet holding position into its auxiliary ratchet releasing position; and, a step 1300 of operably connecting the release lever 210 to the auxiliary ratchet 44' with a spring member 220 to facilitate movement of the auxiliary ratchet 44' from its primary pawl enabling position to its primary pawl disabling position when the release lever 210 is moved from its non-actuated position into its actuated position.

In accordance with another aspect, the method 1000 can include a step 1400 of engaging a first spring segment 226 of the spring member 220 with the release lever 210 and engaging a second spring segment 230 of the spring member 220 with the auxiliary ratchet 44'.

In accordance with another aspect, the method 1000 can include a step 1500 of coupling a coiled segment 222 of the spring member 220 to the release lever 210.

In accordance with another aspect, the method 1000 can include a step 1600 of configuring the spring member 220 to be loaded to a pre-loaded state as the release lever 210 moves relative to the auxiliary ratchet 44' from its non-actuated position toward its actuated position, wherein the pre-loaded state of the spring member 220 assists in moving the auxiliary ratchet 44' toward its primary pawl disabling position during the release operation.

In accordance with another aspect, the method 1000 can include a step 1700 of configuring the spring member 220 to hold the release lever 210 in its actuated position during an initial stage of a latch reset operation whereat the release lever 210 is returned to its non-actuated position.

In accordance with another aspect, the method 1000 can include a step 1800 of providing the spring member 220 as a torsion spring.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A closure latch assembly, comprising:

a primary ratchet movable between a striker capture position whereat the primary ratchet is positioned to retain a striker and a striker release position whereat the primary ratchet is positioned to release the striker, wherein the primary ratchet is biased towards its striker release position;

a primary pawl movable between a ratchet holding position whereat the primary pawl is positioned to hold the primary ratchet in its striker capture position and a ratchet releasing position whereat the primary pawl permits the movement of the primary ratchet out of its striker capture position, wherein the primary pawl is biased towards its ratchet holding position;

an auxiliary ratchet movable between a primary pawl enabling position whereat the auxiliary ratchet permits the primary pawl to be biased toward its ratchet holding position and a primary pawl disabling position whereat the auxiliary ratchet positions the primary pawl in its ratchet releasing position, wherein the auxiliary ratchet is biased towards its primary pawl disabling position;

an auxiliary pawl movable between an auxiliary ratchet holding position whereat the auxiliary pawl is positioned to hold the auxiliary ratchet in its primary pawl enabling position and an auxiliary ratchet releasing position whereat the auxiliary pawl is positioned to permit movement of the auxiliary ratchet to its primary pawl disabling position, wherein the auxiliary pawl is biased towards the auxiliary ratchet holding position;

a release lever moveable from a non-actuated position into an actuated position for moving the auxiliary pawl from its auxiliary ratchet holding position into its auxiliary ratchet releasing position;

a power actuator for moving the release lever from its non-actuated position into its actuated position to provide a power latch release operation, and for moving the release lever from its actuated position to its non-actuated position to provide a power latch reset operation; and a resilient link arrangement interconnecting the release lever to the auxiliary ratchet to facilitate movement of the auxiliary ratchet from its primary pawl enabling position to its primary pawl disabling position when the release lever is moved from its non-actuated position into its actuated position during the power latch release operation, wherein the resilient link arrangement includes a spring member having a first spring segment acting on the release lever and a second spring segment acting on the auxiliary ratchet, wherein the spring member is loaded to a pre-loaded state as the release lever moves relative to the auxiliary ratchet from its non-actuated position toward its actuated position, and wherein the pre-loaded state of the spring member assists in moving the auxiliary ratchet toward its primary pawl disabling position during the power latch release operation .

2. The closure latch assembly of claim 1, wherein the resilient link arrangement is adapted to bias the auxiliary ratchet toward its primary pawl disabling position.

3. The closure latch assembly of claim 1, wherein the primary pawl is pivotably mounted to the auxiliary ratchet.

4. The closure latch assembly of claim 1, wherein the spring member is a torsion spring.

5. The closure latch assembly of claim 4, wherein the torsion spring has a coiled segment supported on the release lever, a first end tang defining the first spring segment and engaging the release lever, and a second end tang defining the second spring segment and engaging the auxiliary ratchet.

6. The closure latch assembly of claim 1, wherein the spring member is operable to hold the release lever in its actuated position during an initial stage of the power latch reset operation.

7. The closure latch assembly of claim 6, wherein the spring member is operable to move the auxiliary ratchet toward its primary pawl enabling position after the initial stage of the power latch reset operation.

8. The closure latch assembly of claim 1, wherein the release lever has an auxiliary pawl drive lug configured to engage a driven lug on the auxiliary pawl as the release lever moves from its non-actuated position to its actuated position to facilitate movement of the auxiliary pawl from its auxiliary ratchet holding position into its auxiliary ratchet releasing position.

9. The closure latch assembly of claim 8, wherein the spring member moves the auxiliary ratchet toward its primary pawl disabling position in response to the auxiliary pawl becoming disengaged from the auxiliary ratchet.

10. A closure latch assembly, comprising:

a primary ratchet movable between a striker capture position whereat the primary ratchet is positioned to retain a striker and a striker release position whereat the primary ratchet is positioned to release the striker, wherein the primary ratchet is biased towards its striker release position;

a primary pawl movable between a ratchet holding position whereat the primary pawl is positioned to hold the primary ratchet in its striker capture position and a ratchet releasing position whereat the primary pawl permits the movement of the primary ratchet out of its striker capture position, wherein the primary pawl is biased towards its ratchet holding position;

an auxiliary ratchet movable between a primary pawl enabling position whereat the auxiliary ratchet permits the primary pawl to be biased toward its ratchet holding position and a primary pawl disabling position whereat the auxiliary ratchet positions the primary pawl in its ratchet releasing position, wherein the auxiliary ratchet is biased towards its primary pawl disabling position;

an auxiliary pawl movable between an auxiliary ratchet holding position whereat the auxiliary pawl is positioned to hold the auxiliary ratchet in its primary pawl enabling position and an auxiliary ratchet releasing position whereat the auxiliary pawl is positioned to permit movement of the auxiliary ratchet to its primary pawl disabling position, wherein the auxiliary pawl is biased towards the auxiliary ratchet holding position;

a release lever moveable from a non-actuated position into an actuated position for moving the auxiliary pawl from its auxiliary ratchet holding position into its auxiliary ratchet releasing position; a spring member interconnecting the release lever to the auxiliary ratchet to facilitate movement of the auxiliary ratchet from its primary pawl enabling position to its primary pawl disabling position when the release lever is moved from its non-actuated position into its actuated position; and an actuator for moving the release lever from its non-actuated position into its actuated position to provide a latch release operation, and for moving the release lever from its actuated position into its non-actuated position to provide a ratchet reset operation, wherein the spring member is loaded to a pre-loaded state as the release lever moves relative to the auxiliary ratchet from its non-actuated position toward its actuated position, and wherein the pre-loaded state of the spring member assists in moving the auxiliary ratchet toward its primary pawl disabling position during the latch release operation.

11. The closure latch assembly of claim 10, wherein the spring member is adapted to bias the auxiliary ratchet toward its primary pawl disabling position.

12. The closure latch assembly of claim 10, wherein the spring member has a first spring segment engaging the release lever and a second spring segment engaging the auxiliary ratchet.

13. The closure latch assembly of claim 10, wherein the spring member is operable to hold the release lever in its actuated position during an initial stage of the latch reset operation, and wherein the spring member is operable to move the auxiliary ratchet toward its primary pawl enabling position after the initial stage of the latch release operation.

14. The closure latch assembly of claim 10, wherein the release lever is configured to engage the auxiliary pawl as the release lever moves from its non-actuated position into its actuated position to facilitate movement of the auxiliary pawl from its auxiliary ratchet holding position into its auxiliary ratchet releasing position.

15. A method of facilitating movement of a primary ratchet of a closure latch assembly from striker capture position to a striker release position during a release operation of the closure latch assembly, comprising:

providing the closure latch assembly having a primary pawl movable between a ratchet holding position whereat the primary pawl is positioned to hold the primary ratchet in the striker capture position and a ratchet releasing position whereat the primary pawl permits the movement of the primary ratchet out of the striker capture position; an auxiliary ratchet movable between a primary pawl enabling position whereat the auxiliary ratchet permits the primary pawl to be biased toward its ratchet holding position and a primary pawl disabling position whereat the auxiliary ratchet positions the primary pawl in its ratchet releasing position; an auxiliary pawl movable between an auxiliary ratchet holding position whereat the auxiliary pawl is positioned to hold the auxiliary ratchet in its primary pawl enabling position and an auxiliary ratchet releasing position whereat the auxiliary pawl is positioned to permit movement of the auxiliary ratchet to its primary pawl disabling position;

providing a release lever moveable from a non-actuated position into an actuated position for moving the auxiliary pawl from its auxiliary ratchet holding position into its auxiliary ratchet releasing position;

operably connecting the release lever to the auxiliary ratchet with a spring member to facilitate movement of the auxiliary ratchet from its primary pawl enabling position to its primary pawl disabling position when the release lever is moved from its non-actuated position into its actuated position; and loading the spring member to a pre-loaded state as the release lever moves relative to the auxiliary ratchet from its non-actuated position toward its actuated position, wherein the pre-loaded state of the spring member assists in moving the auxiliary ratchet toward its primary pawl disabling position.

16. The method of claim 15, further including engaging a first spring segment of the spring member with the release lever and engaging a second spring segment of the spring member with the auxiliary ratchet.

17. The method of claim 16, further including coupling a coiled segment of the spring member to the release lever.

18. The method of claim , further including configuring the spring member to hold the release lever in its actuated position during an initial stage of a latch reset operation whereat the release lever is returned to its non-actuated position.

19. The method of claim 15, further including providing the spring member as a torsion spring.

* * * * *